US012791185B2

(12) United States Patent
Makwana et al.

(10) Patent No.: US 12,791,185 B2
(45) Date of Patent: Nov. 10, 2026

(54) DUAL-FUEL BURNER AND METHOD OF OPERATION

(71) Applicant: Air Products and Chemicals, Inc., Allentown, PA (US)

(72) Inventors: Anandkumar Makwana, Breinigsville, PA (US); Mark Daniel D'Agostini, Allentown, PA (US); Joshua E. Middaugh, Gilbertsville, PA (US)

(73) Assignee: Air Products and Chemicals, Inc., Allentown, PA (US)

( * ) Notice: Subject to any disclaimer, the term of this patent is extended or adjusted under 35 U.S.C. 154(b) by 429 days.

(21) Appl. No.: 18/233,367

(22) Filed: Aug. 14, 2023

(65) Prior Publication Data

US 2025/0060098 A1 Feb. 20, 2025

(51) Int. Cl.

| | |
|---|---|
| ***F23D 17/00*** | (2006.01) |
| ***F23D 11/38*** | (2006.01) |
| ***F23G 7/06*** | (2006.01) |

(52) U.S. Cl.

CPC ..... *F23D 17/002* (2013.01); *F23D 11/383* (2013.01); *F23G 7/065* (2013.01); *F23D 2202/00* (2013.01); *F23D 2900/00014* (2013.01); *F23D 2900/00015* (2013.01)

(58) Field of Classification Search

CPC ..... F23D 14/22; F23D 17/002

USPC ..... 431/187, 284, 6

See application file for complete search history.

(56) References Cited

U.S. PATENT DOCUMENTS

| | | | | |
|---|---|---|---|---|
| 3,163,203 | A * | 12/1964 | Ihlenfield | F23D 17/00 239/416.5 |
| 4,451,230 | A * | 5/1984 | Bocci | F23D 11/004 431/189 |
| 4,610,625 | A * | 9/1986 | Bunn | F23Q 3/008 431/351 |
| 4,748,919 | A | 6/1988 | Campobenedetto et al. | |
| 5,308,239 | A | 5/1994 | Bazarian et al. | |
| 5,871,343 | A | 2/1999 | Baukal, Jr. et al. | |
| 6,019,595 | A | 2/2000 | Wulfert et al. | |

(Continued)

FOREIGN PATENT DOCUMENTS

| | | |
|---|---|---|
| AU | 684296 | 12/1997 |
| CN | 111336515 | 6/2020 |

(Continued)

OTHER PUBLICATIONS

Charles E. Baukal, Jr., "Oxygen-enhanced combustion", CRC press, 2010.

*Primary Examiner* — Vivek K Shirsat

(74) *Attorney, Agent, or Firm* — Jason M. Ploeger

(57) ABSTRACT

The invention relates to particular burners, and e.g. to a burner comprising a central main fuel lance, a pilot fuel conduit, a main oxidant conduit, an auxiliary oxidant conduit, and optionally a secondary fuel conduit, which are arranged in a particular and advantageous way to surround each other at least in their downstream sections. The invention further relates to furnaces including the burners and methods of operating the burners. Among others, the burners of the present invention allow a particularly advantageous way of including a pilot burner as an integral part of the main burner to ignite liquid fuel flame in a cold furnace. If required, the pilot flame can assist in extending the flammability limit or operating range of the liquid fuel burner.

19 Claims, 13 Drawing Sheets

(56) References Cited

U.S. PATENT DOCUMENTS

| | | | |
|---|---|---|---|
| 6,835,360 | B2 | 12/2004 | Warren |
| 6,951,454 | B2 | 10/2005 | Sarv et al. |
| 7,901,204 | B2 | 3/2011 | Stephens et al. |
| 8,727,767 | B2 | 5/2014 | Watson et al. |
| 8,899,969 | B2 | 12/2014 | Gard et al. |
| 9,664,381 | B2 | 5/2017 | Gangoli et al. |
| 2002/0197574 | A1 | 12/2002 | Jones et al. |
| 2004/0146821 | A1 | 7/2004 | Joshi |
| 2009/0113893 | A1 | 5/2009 | Li et al. |
| 2014/0069079 | A1 | 3/2014 | Koizumi et al. |
| 2016/0169505 | A1 | 6/2016 | Ilchenko et al. |
| 2018/0216828 | A1 | 8/2018 | Johansson et al. |

FOREIGN PATENT DOCUMENTS

| | | |
|---|---|---|
| DE | 2530170 | 1/1977 |
| EP | 1850067 | 10/2007 |
| EP | 2014981 | 1/2009 |
| EP | 3967925 | 3/2022 |
| JP | S54141028 | 10/1979 |
| JP | 2016191533 | 11/2016 |
| WO | 2022053176 | 3/2022 |

* cited by examiner

DUAL-FUEL BURNER AND METHOD OF OPERATION

FIELD

The present invention relates to burners and particularly to industrial burners that are configured to use at least a liquid fuel and employ a pilot burner.

BACKGROUND

The present invention relates to burners that can be used in applications that involve burning of at least a liquid fuel—and particular to burners for industrial applications.

Ignition of liquid fuel in a cold furnace upon starting burner operation generally is a challenge.

In the art, a pilot burner is often used to ignite the liquid fuel. Such a pilot burner is a separate burner that lights the liquid fuel from one side. However, the use of an external pilot burner can cause asymmetry effects in the flame which can potentially lead to uneven heat flux, flame impingement on the sidewalls or worst-case flame blow-off when pilot fuel is turned off.

In other cases in the art, the furnaces are first heated using other burners that burn gaseous fuels to reach auto-ignition temperature of a liquid fuel burner prior to starting the liquid fuel supply. However, this leads to increase in the overall cost of the burner and associated equipment, increased start-up time, etc.

It is therefore a first object of the present invention to provide an advantageous burner which alleviates or overcomes the above problematic issues.

A further challenge of industrial burners includes that the combustion usually needs to be completed within a small space, in particular where small furnaces are used such as in steam methane reforming. It is important for the flame length to be smaller than the furnace length. However, a liquid fuel flame length is generally longer as compared to gaseous fuels when using nearly identical burners. This is due to several reasons but most importantly due to two factors: First, liquid fuel generally needs to be atomized before the fuel droplets are mixed with the oxidant/air and burned to produce a stable flame. Second, liquid fuel usually has a large volume fraction of aromatics and high molecular weight fuels that produces soot and it is challenging to burn or completely oxidize the soot produced within a short distance.

It is therefore a further object of the present invention to provide a burner which meets this challenge.

Particular prior art designs of burners may be summarized as follows:

US20070172784 (cf. U.S. Pat. No. 7,901,204B2) describes a dual burner for liquid and gaseous fuel, but no mechanism is discussed to start the burner operation using liquid fuel and no details about a respective pilot burner are provided.

US20120315586 (cf. U.S. Pat. No. 889,996) describes a dual fuel burner method and staged combustion, but neither mentions a pilot burner as part of the main burner, nor combusting e.g. low Btu gaseous fuels. Besides, liquid fuel is preheated (flash vaporization), whereas our burner doesn't need any preheated liquid fuel.

US20180216828A1 (cf. U.S. Pat. No. 889,996) describes a premixed burner for dual fuel for gaseous and liquid fuels, but there is no mention of a pilot burner.

US20040234912 (cf. U.S. Pat. No. 6,951,454) describes a dual fuel burner for pulverized coal and natural gas to produce short flame and low emissions, but does not include liquid fuels or mention an integrated pilot burner port.

U.S. Pat. No. 4,748,919A claims a multi-fuel burner with solid fuel in central conduit, liquid lance inside first tube, second tube for another fuel, air in outer conduit. It uses an igniter assembly of the known type in the burner, which would still need an external ignition assembly. In more detail, the igniter comes from the side port when a liquid nozzle is used.

SUMMARY OF THE INVENTION

In general, the present invention relates to the subject-matter as defined in the claims.

The present invention is particularly based on the finding that objects described above can be solved, if a pilot burner is integrated as part of a main burner. Hence, according to a special feature of the present burners, the main fuel conduit is surrounded by the pilot fuel conduit.

In particular, the present invention provides a burner comprising a central main fuel lance for supply of an atomized liquid fuel having a main fuel outlet at its downstream end, a main oxidant conduit for supply of a main oxidant, having a main oxidant outlet at its downstream end, a pilot fuel conduit for supply of a gaseous pilot fuel, having a pilot fuel outlet at its downstream end, and an auxiliary oxidant conduit for supply of an auxiliary oxidant, having an auxiliary oxidant outlet at its downstream end, wherein at least in the downstream portion of the burner, in which main fuel outlet, main oxidant outlet, pilot fuel outlet and auxiliary oxidant outlet are present, the pilot fuel conduit, the auxiliary oxidant conduit and the main oxidant conduit are arranged concentrically around the central main fuel lance so that central main fuel lance is surrounded by the pilot fuel conduit, the auxiliary oxidant conduit and the main oxidant conduit, wherein at least in said downstream portion of the burner the central main fuel lance, the pilot fuel conduit and the auxiliary oxidant conduit are surrounded by the main oxidant conduit, and wherein means for igniting the pilot fuel are present upstream the main fuel outlet inside the pilot fuel conduit and/or the auxiliary oxidant conduit. Variants as well as embodiments of the burner of the invention are disclosed herein below in detail.

Generally, the burners of the invention can be used in any application that, for example, needs high heating applications like steam methane reforming, reheat furnaces in steel industry, or secondary melting furnaces.

As the person skilled in the art will readily appreciate, the burners of the present invention advantageously involve the use of a pilot fuel conduit and an auxiliary oxidant conduit as a particular pilot burner that is an integral part of the (main) burner itself. The said auxiliary oxidant conduit may furthermore also be used to provide (additional) oxidant for the main fuel, such as a liquid fuel.

Further provided by the present invention are, among others, a furnace including the burner of the present invention as well as methods for operating said burners.

The burners of the invention are designed to advantageously initiate the burner operation by using a particular design of a pilot burner as integral part of the burner, which allows for reliable and reproducible ignition of the main fuel (a liquid fuel) in a symmetric and stable manner, and further allows for a combustion at a comparatively short length, thus overcoming prior art issues identified above. Specifically, the pilot gaseous fuel generates a small flame in the vicinity of the main fuel lance (such as the oil lance) during the start-up that helps to reliability and safely ignite, even in a cold furnace, the air-atomized liquid fuel. In addition, the pilot gaseous fuel may advantageously be turned off after the liquid fuel flame lights.

Furthermore, if needed, the pilot burner in context with the burners of the present invention can also assist in very low turn down of the liquid fuel lance operation by providing a continuous source of ignition. This can enable a wider operating range for liquid fuel burning.

Moreover, in accordance with specific embodiments of the invention, particularly the combination of low exit velocity of a liquid fuel along with dimensional features of (swirl) air and presence of low velocity auxiliary oxidant (e.g. pilot air) close to the liquid fuel lance help to anchor the liquid fuel flame in a cold furnace while also producing a short flame across a wider range of turndown ratio-thus overcoming prior art issues identified above.

Besides, the burner may be operated in a cold furnace (that is <400 F average temp during start-up sequence of the burner) without the need of oxygen assistance or a continuous ignition source. The burner may further be stably operated in a fuel lean, low flame temperature mode. The burner produces a stable flame (without any lift-off) over a very broad range of equivalence ratio, even with an equivalence ratio as low as 0.25. These features enable pre-heating of the process furnace at a controlled rate to allow the process to initiate and come to a steady-state condition within a time-frame dictated by process requirements. The equivalence ratio is defined as the ratio of the actual fuel/air molar ratio to the stoichiometric fuel/air molar ratio.

The burner allows to operate the furnace over a wide range of the ratio of primary to secondary fuel total thermal output (i.e. firing rate ratio).

Particular (further) advantages of the burners of the present invention are disclosed herein below.

BRIEF DESCRIPTION OF THE DRAWINGS

The present invention will hereinafter be described in conjunction with the appended figures wherein like reference numerals denote like elements.

DETAILED DESCRIPTION

Figure 1A:
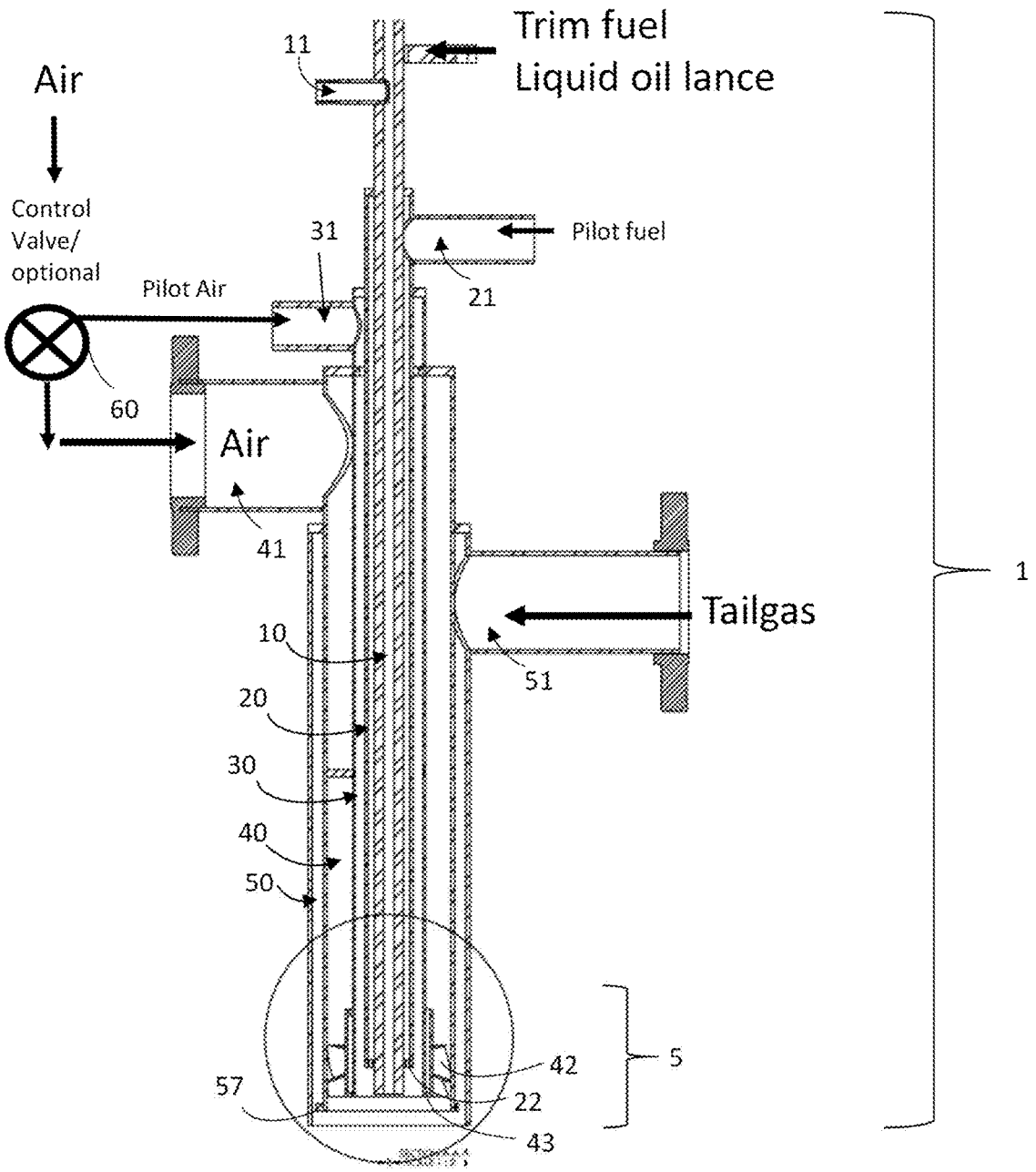
FIG. 1*a* is a side cross-sectional view of an embodiment of a burner of the present invention, which is configured to optionally comprise a common control valve for the main and auxiliary oxidant conduit and which shows exemplary positions of the fuel connectors and oxidant connectors.
Figure 1B:
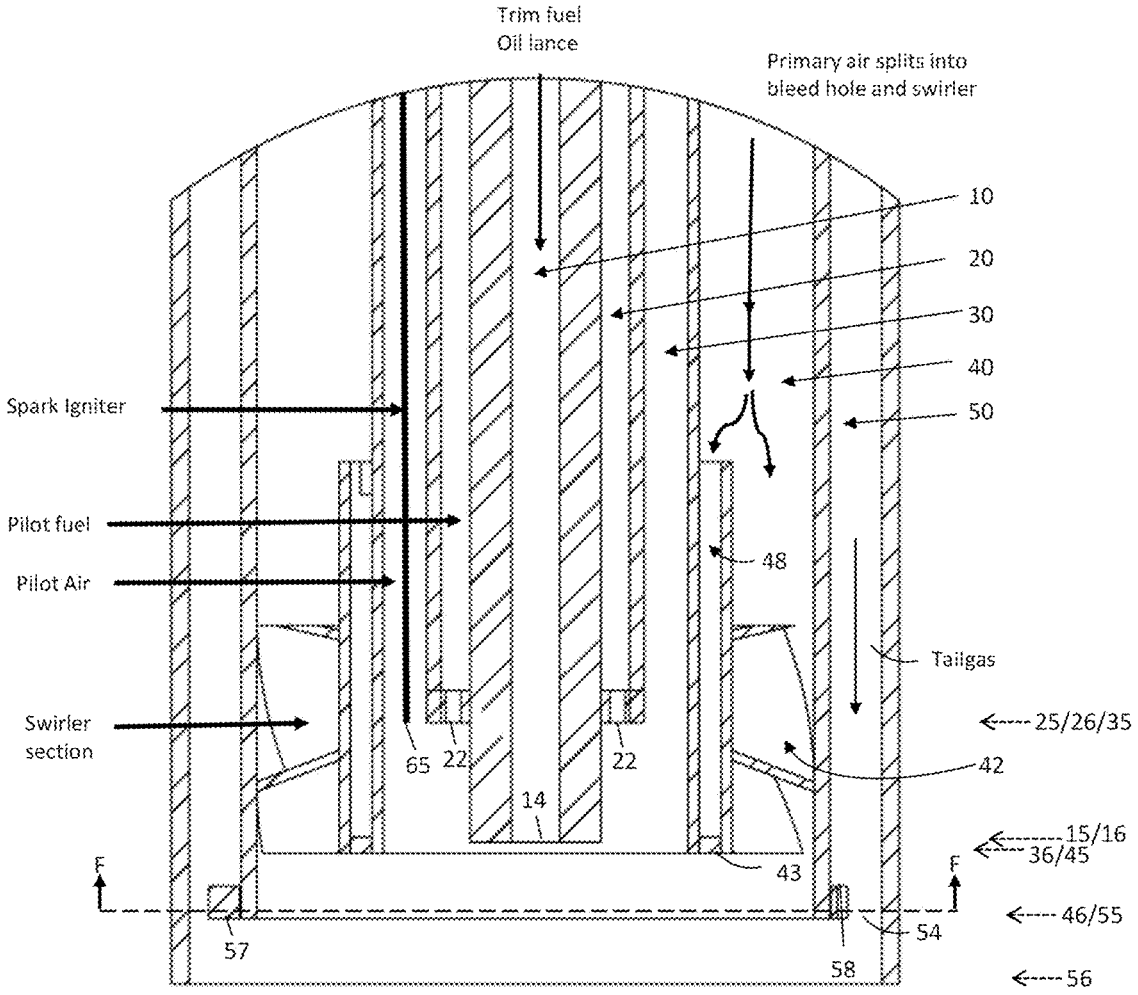
FIG. 1*b* is an exemplary detailed side cross-sectional view of the downstream sections of the various conduits and characteristic features of an embodiment e.g. involving air as the oxidants, oil as the main fuel and tailgas as the secondary fuel.
Figure 1C:
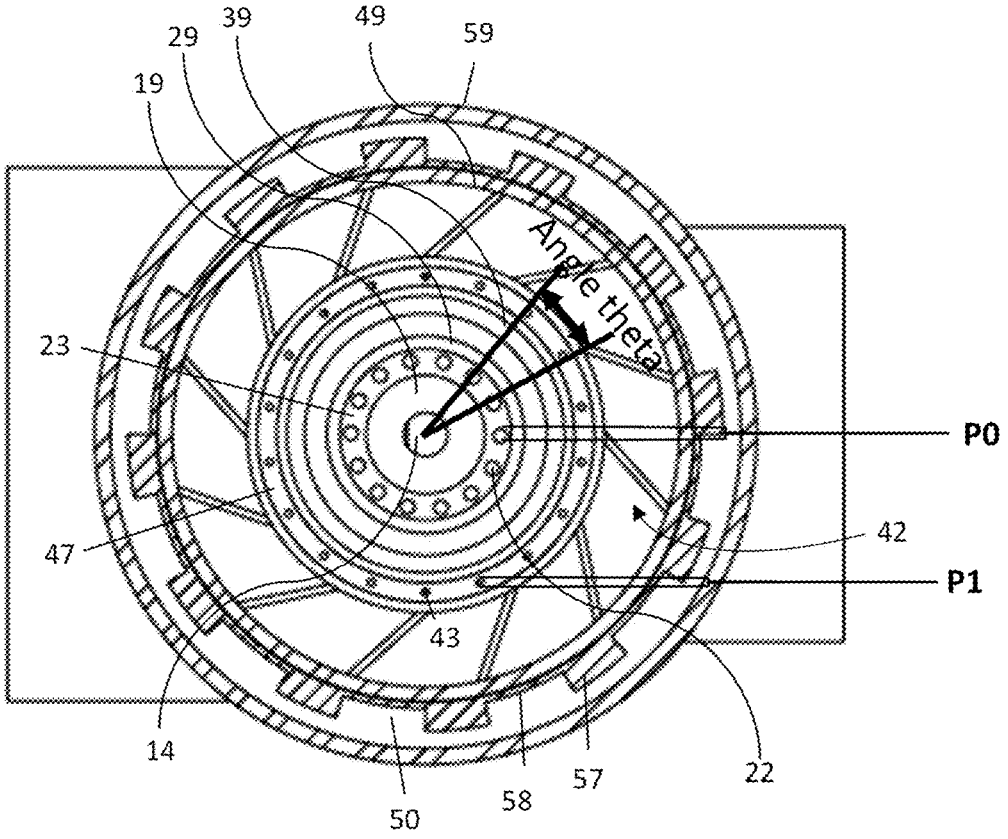
FIG. 1*c* is an exemplary detailed cross-sectional view of the embodiment depicted in FIG. 1*b*, e.g. depicting the optional features of air bleed holes of the main oxidant conduit and turbulence generator plates of the secondary fuel conduit.
Figure 2A:
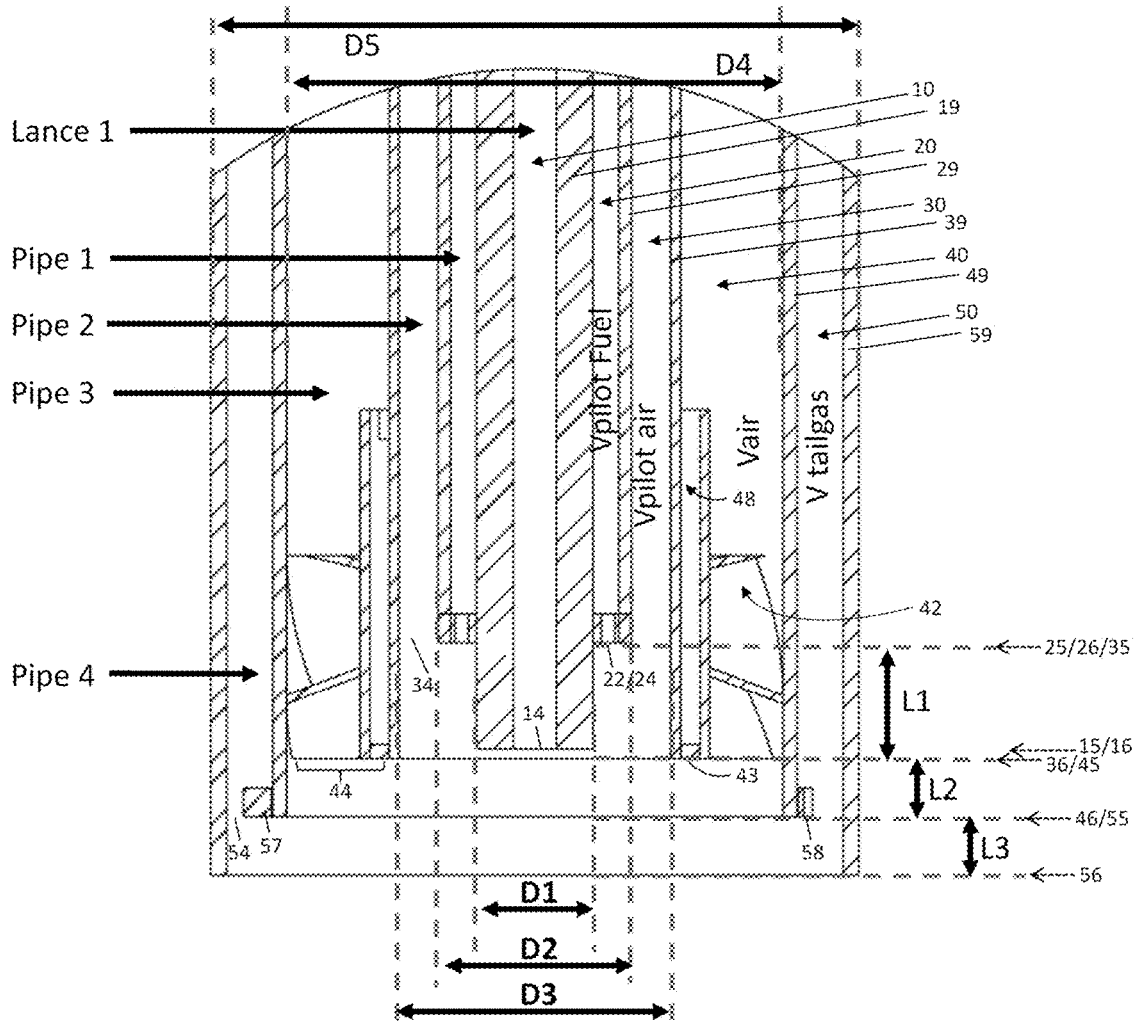
FIG. 2*a* is an exemplary detailed side cross-sectional view of the downstream sections of the various conduits and characteristic features of an exemplary embodiment of the burners of the invention highlighting the diameters D1 to D5 and distances L1 to L3 according to particular embodiments defined herein, wherein the conduits are named according to a particular embodiment and wherein velocities of oxidants (here: air) and the second and pilot fuel are depicted.
Figure 2B:
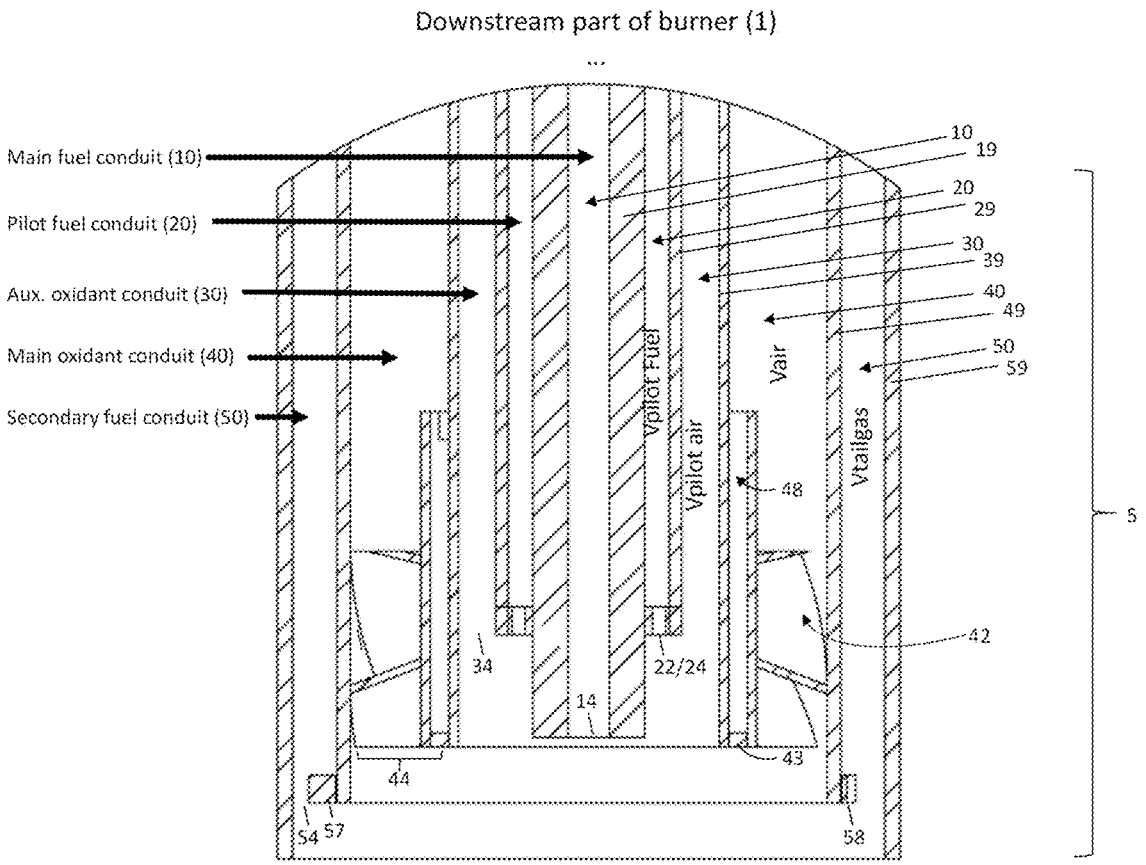
FIG. 2*b* is a corresponding view using the general designations for the conduits of this particular embodiment.
Figure 3A:
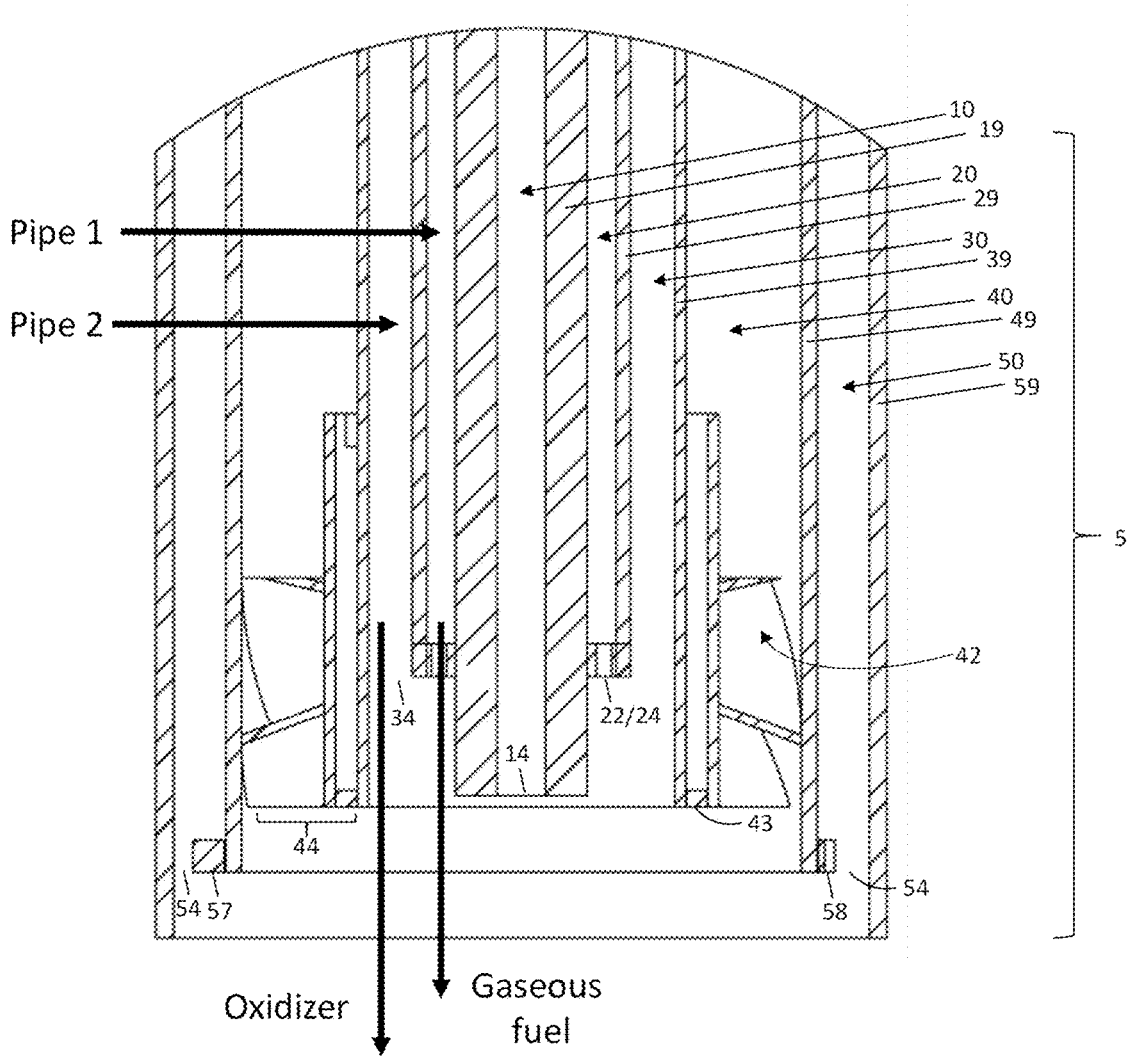
FIG. 3*a* depicts a preferred embodiment related to the burner depicted in FIG. 2*a*/2*b*, wherein the pilot fuel conduit carries a "gaseous fuel" and the auxiliary oxidant conduit carries the oxidant which is designated as "oxidizer". The pilot flame is "on".
Figure 3B:
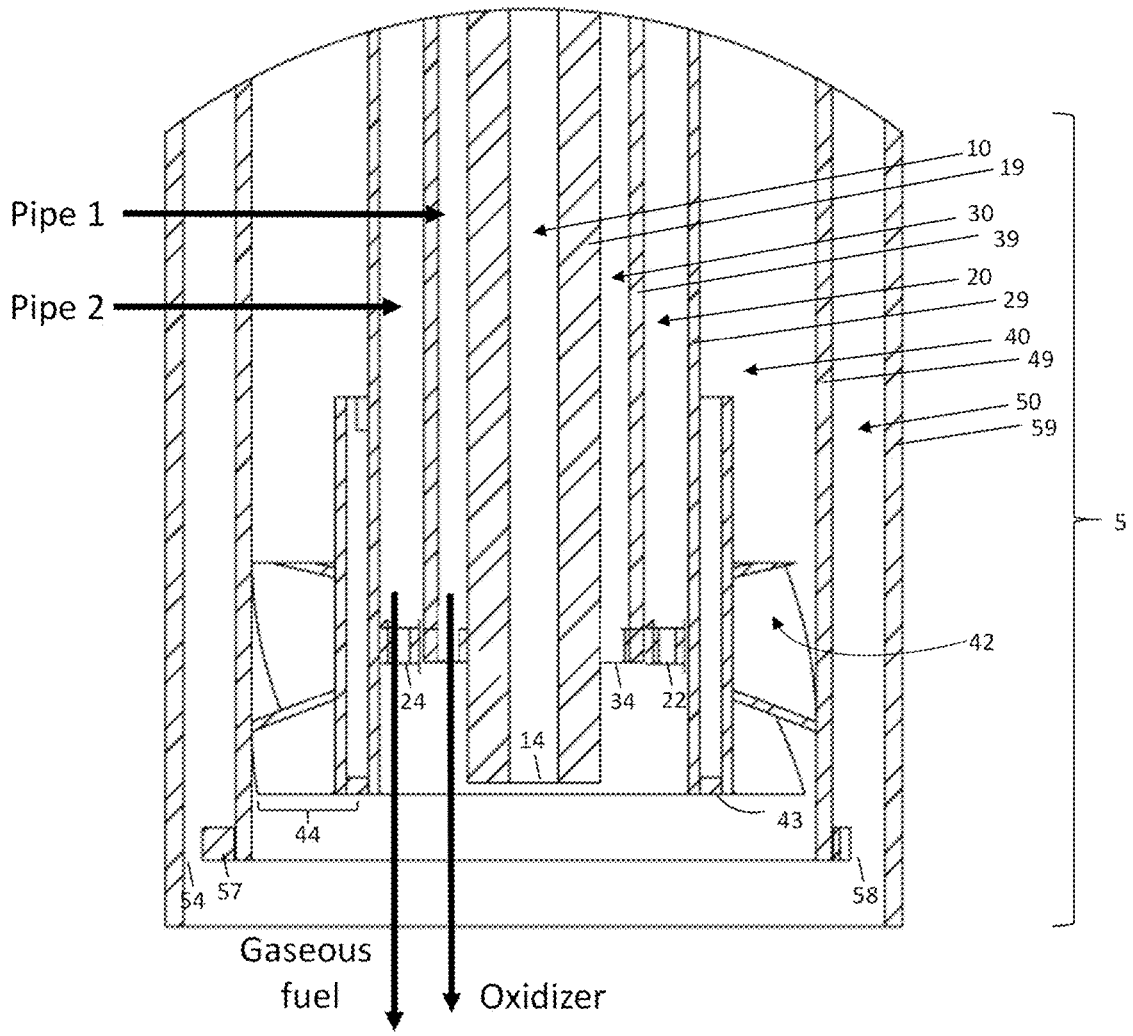
FIG. 3*b* depicts an alternative embodiment to the embodiment depicted in FIG. 3*a*, wherein the pilot fuel conduit that carries a "gaseous fuel" and the auxiliary oxidant conduit that carries the oxidant which is designated as "oxidizer" are arranged differently around the central main fuel lance.
Figure 4A:
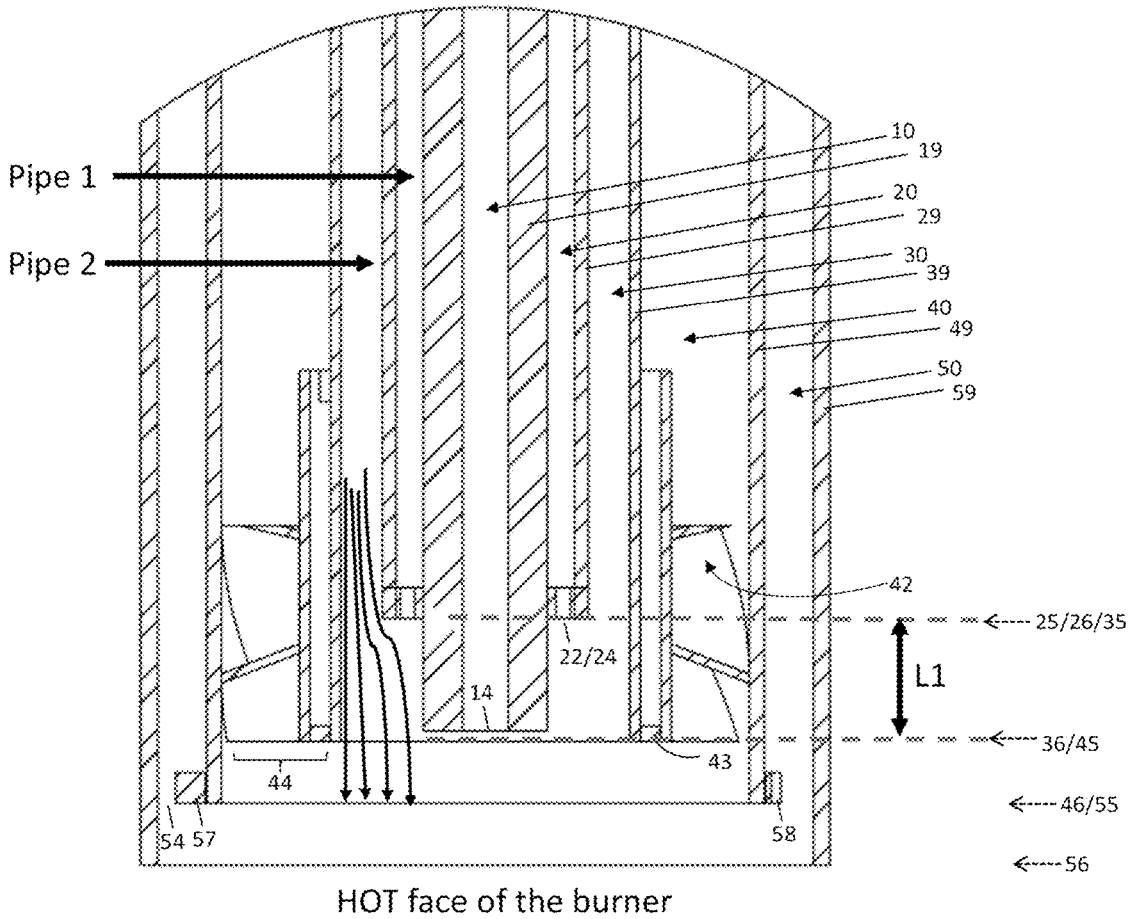
FIG. 4*a* essentially corresponds to the embodiment of FIG. 3*a*, while highlighting the optional distance L1, where the pilot flame is "off". In more detail, the pilot fuel tube is recessed by L1 in order to optimize the length for the pilot air to partially or fully develop before it comes out of the HOT face of the burner. Without intending to be bound by theory, this prevents backflow of combustibles inside the fuel pipe 1 when the fuel is shut off.
Figure 4B:
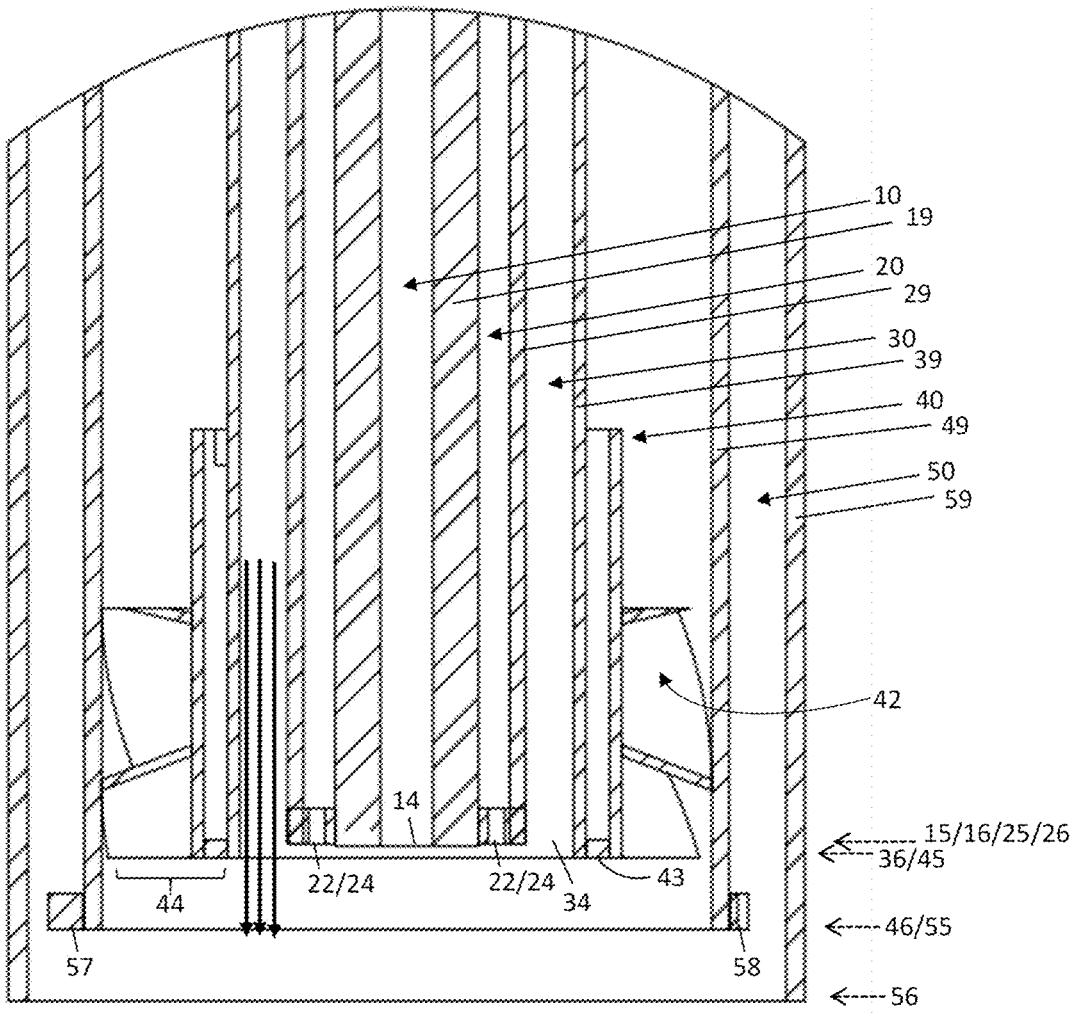
FIG. 4*b* shows an alternative (less preferred) corresponding embodiment not using the said distance L1.
Figure 4C:
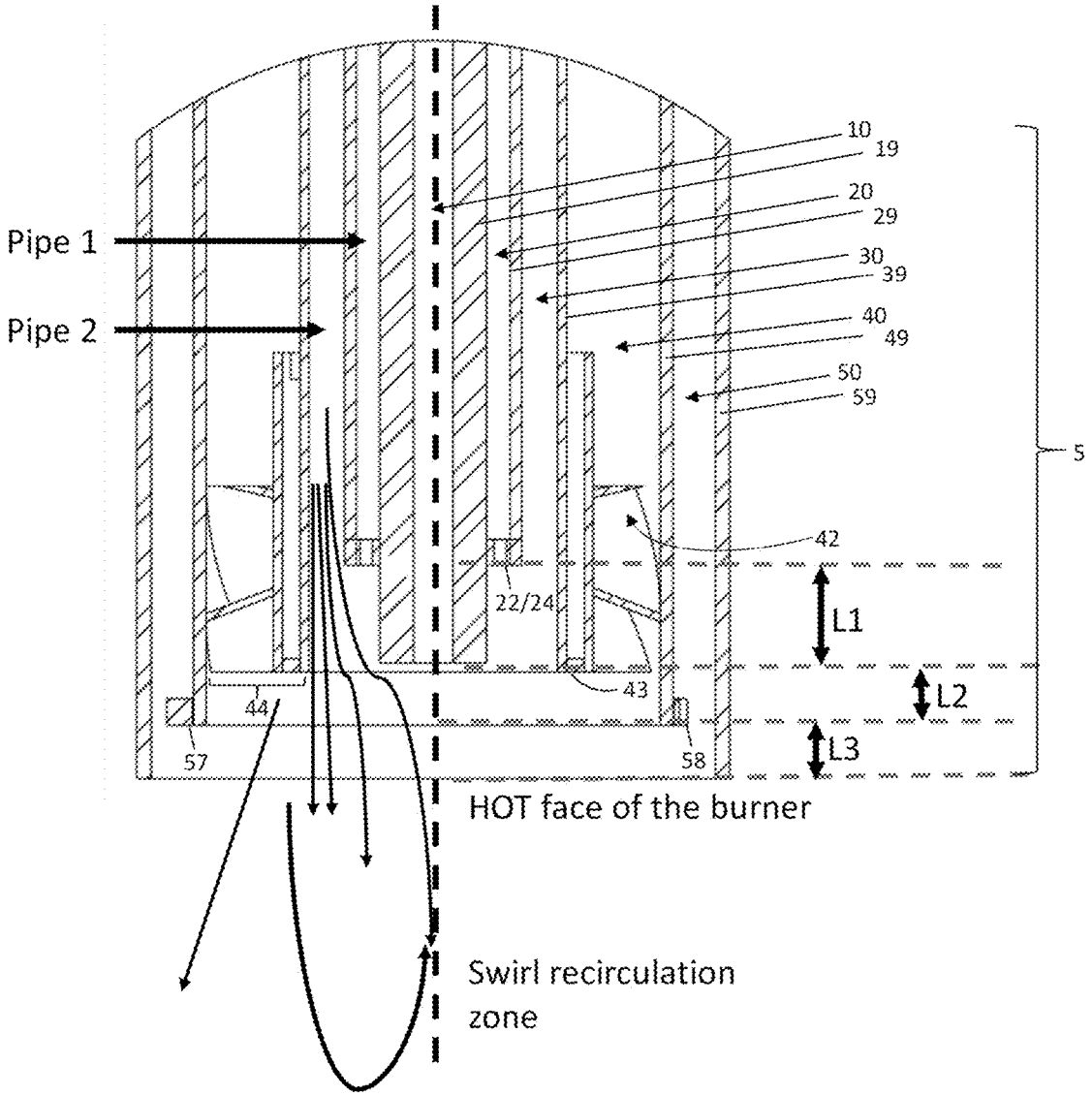
FIG. 4*c* also essentially corresponds to the embodiment of FIG. 3*a*, while highlighting the optional distances L1, L2 and L3. In detail, in a particular embodiment, the fuel tube is recessed by L2+L3 length in order to allow the pilot air stream to develop an envelope around the liquid fuel lance before it comes out of the HOT face of the burner. Without intending to be bound by theory, this helps to keep the oil lance cool when the liquid fuel is shut off by preventing the hot gases from the swirl recirculation zone from impinging the exit of the oil lance.
Figure 4D:
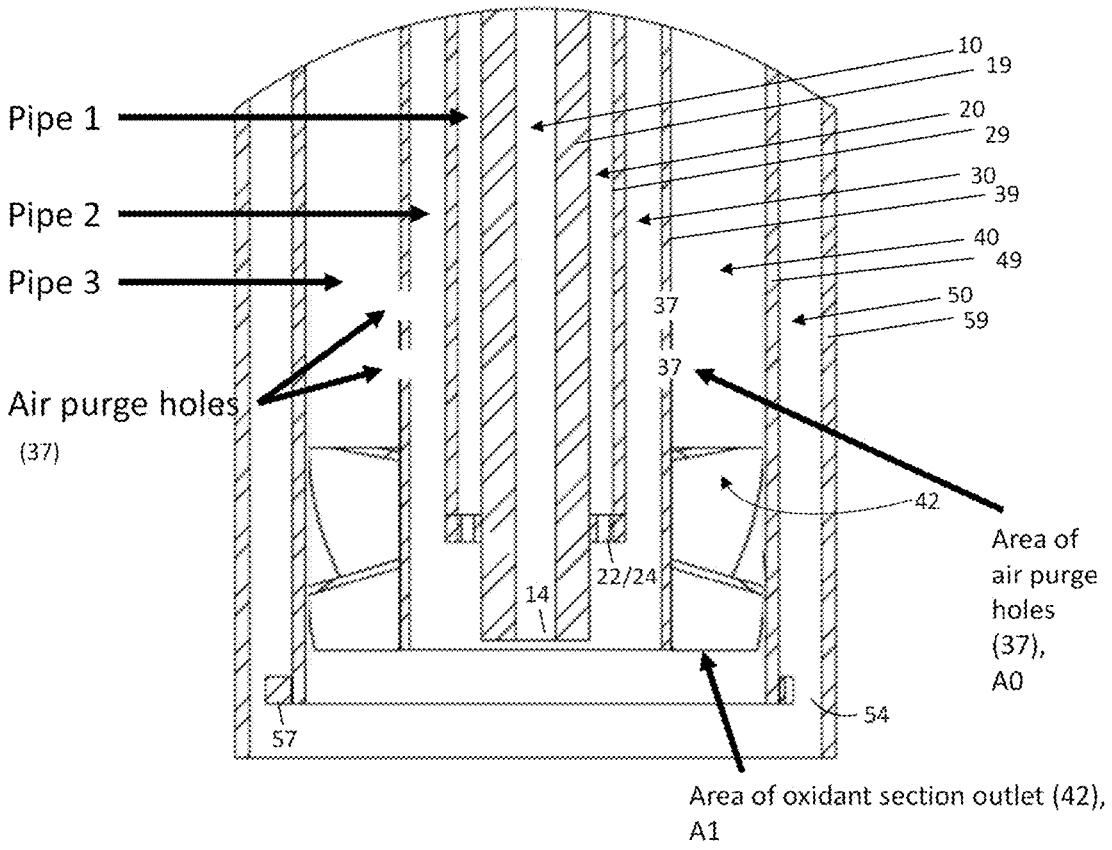
FIG. 4*d* depicts an alternative general embodiment. In a particular embodiment of this alternate design, the pilot air supply in Pipe 2 can be supplied through 'air purge holes' on the wall of the Pipe 2. These holes (numbers and diameter, series of holes) are predetermined based on the area ratio of the holes and swirl air exit area. The pre-calculated ratio is dependent on the amount of air that is required in the pilot air pipe and can readily be determined by the skilled person.

The present invention generally provides burners, furnaces, and methods as defined in the claims.

In a first aspect herein, there is provided a burner, comprising a central main fuel lance) for supply of an atomized liquid fuel having a main fuel outlet at its downstream end, a main oxidant conduit for supply of a main oxidant (e.g., air, oxygen, or combinations thereof), having a main oxidant outlet at its downstream end, a pilot fuel conduit for supply of a gaseous pilot fuel, having a pilot fuel outlet at its downstream end, and an auxiliary oxidant conduit for supply of an auxiliary oxidant, having an auxiliary oxidant outlet at its downstream end, wherein at least in the downstream portion of the burner, in which main fuel outlet, main oxidant outlet, pilot fuel outlet and auxiliary oxidant outlet are present, the pilot fuel conduit, the auxiliary oxidant conduit and the main oxidant conduit are arranged concentrically around the central main fuel lance so that central main fuel lance is surrounded by the pilot fuel conduit, the auxiliary oxidant conduit and the main oxidant conduit, wherein at least in said downstream portion of the burner the central main fuel lance, the pilot fuel conduit and the auxiliary oxidant conduit are surrounded by the main oxidant conduit, and wherein means for igniting the pilot fuel are present upstream the main fuel outlet inside the pilot fuel conduit and/or the auxiliary oxidant conduit.

In preferred embodiments of said first aspect, said burner further comprises a secondary fuel conduit for supply of a secondary fuel, having a secondary fuel outlet at its downstream end, wherein at least in the downstream portion of the burner, in which main fuel outlet, main oxidant outlet, pilot fuel outlet and auxiliary oxidant outlet are present, the secondary fuel conduit is arranged preferably concentrically around the central main fuel lance, and at least in said downstream portion of the burner, the central main fuel lance, the pilot fuel conduit, the auxiliary oxidant conduit and the main oxidant conduit are surrounded by the secondary fuel conduit.

Preferably, at least in said downstream portion of the burner, the central main fuel lance, and the pilot fuel conduit are surrounded by the auxiliary oxidant conduit.

As used herein, a "downstream portion of the burner, in which main fuel outlet, main oxidant outlet, pilot fuel outlet and auxiliary oxidant outlet are present" refers to a downstream portion that comprises all of main fuel outlet, main oxidant outlet, pilot fuel outlet and auxiliary oxidant outlet. In case that a secondary fuel conduit is additionally present, the said portion further comprises the secondary fuel outlet. Moreover, in case that a swirler section and/or a bleed hole annulus is/are additionally present, the said portion further comprises the swirler section and/or bleed hole annulus. The term "downstream portion" is used herein exchangeably herein with the term "downstream section".

Generally, in the present invention, a certain conduit (or lance, respectively) is described as being "surrounded" by a certain other conduit (or several other conduits, respectively) if said conduit (or lance) has a smaller diameter than said other conduit(s) and is arranged inside said other conduit(s). However, for being "surrounded" by another conduit, a given conduit does not need to be entirely surrounded by the other, but may also extend further downstream and/or upstream from the other. Respective definitions apply herein, where a given element is said to be "arranged around" another element.

Preferably herein, a conduit that is described to be surrounded by (an) other conduit(s) shares its longitudinal axis with the other(s).

In preferred embodiments of the present invention, the pilot fuel conduit, the auxiliary oxidant conduit and the main oxidant conduit (and optionally the secondary fuel conduit) are arranged concentrically around the central main fuel lance.

In particularly preferred embodiments of the present invention, the pilot fuel conduit, the auxiliary oxidant conduit and the main oxidant conduit (and optionally the secondary fuel conduit) are arranged concentrically around the central main fuel lance in a section corresponding to at least 20%, preferably in at least 30%, particularly in at least 40%, especially in at least 50%, and in some embodiments in at least 75%, of the total length of the burner, wherein the said section includes the main fuel outlet, main oxidant outlet, pilot fuel outlet and auxiliary oxidant outlet and optionally the secondary fuel outlet. In case that a secondary fuel conduit is additionally present, the said portion preferably further includes the secondary fuel outlet. Moreover, in case that a swirler section and/or a bleed hole annulus is/are additionally present, the said portion preferably further includes the swirler section and/or bleed hole annulus.

Herein, the "total length" of the burner of the invention is determined by establishing the distance between the furthest upstream end of all conduits and the furthest downstream end of all conduits.

In a further preferred embodiment the pilot fuel conduit, the auxiliary oxidant conduit and the main oxidant conduit (and optionally the secondary fuel conduit) are arranged concentrically around the central main fuel lance along their full length.

In preferred embodiments of the invention, where a given conduit is arranged concentrically around another conduit, this results in the formation of a respective annulus.

Consequently, in preferred embodiments herein, the burner is configured in such a way that the pilot fuel and/or the main oxidant, and/or the auxiliary oxidant, and/or the secondary fuel—preferably at least the pilot fuel, more preferably at least the pilot fuel and the auxiliary oxidant—flow(s) through an annulus. In the present invention, such annuli may further be characterized by containing further elements of the respective conduits (such as exit holes, bleed holes, a swirler section and suchlike) as defined elsewhere herein.

Likewise, in preferred embodiments herein, the burner is characterized in that the pilot fuel outlet and/or the main oxidant outlet, and/or the auxiliary oxidant outlet, and/or the secondary fuel outlet-preferably at least the pilot fuel outlet, more preferably at least the pilot fuel outlet and the auxiliary oxidant outlet—are configured as annular rings. In the present invention, such annular rings may be characterized by containing further elements (such as exit holes, bleed holes, a swirler section and suchlike) as defined elsewhere herein.

In accordance with the present invention, the main fuel used in the burner is a liquid fuel, particularly an atomized liquid fuel. In accordance with the present invention the pilot fuel used in the burner is a gaseous fuel.

Generally herein, the specific nature of the fuels and oxidants to be used with the burner of the present invention is not particularly limited.

In accordance with the present invention, preferably, the secondary fuel is a gaseous fuel.

As the person skilled in the art will readily appreciate, the main and secondary fuels may be regarded the principal fuels of the burner of the invention. As opposed to that, the pilot fuel essentially serves for igniting the main fuel. In addition or alternatively, the pilot fuel may assist in very low turn down of the liquid fuel lance operation by providing a continuous source of ignition.

In particular embodiments, the secondary fuel which preferably is a gaseous fuel, may be a tailgas, such as one of various types of tailgases e.g. resulting from industrial processes, or may be a process gas. As non-limiting particular embodiments, the said gaseous fuel may be selected from the group consisting of PSA waste gas, syngas, and a $H_2/CO/CO_2/CH_4$ mixture.

The central main fuel lance may also be referred to herein simply as "lance" (or "lance 1"), and in certain embodiments may also be referred to herein as an oil lance. Besides, the term "main fuel lance" can be interchangeably used herein with "main fuel conduit".

In the present invention, the central main fuel lance is designed as a liquid fuel conduit, particularly a conduit for atomized liquid fuel. Specifically, in the present invention, the central main fuel lance is for supply of an atomized liquid fuel.

Accordingly, the central main fuel lance may also be called a liquid fuel atomization lance. In certain embodiments, the central main fuel lance is an air- or gas-assisted liquid fuel atomization lance. In particular embodiments, the central main fuel lance is an air-assisted liquid fuel atomization lance. In particular embodiments for gas-assisted liquid fuel atomization lance, the ratio of mass flow rate of atomizing gas and mass flow ratio of liquid fuel is useful to be in the range of 0.025 to 0.5. In certain embodiments, the central main fuel lance is a pressure atomized liquid lance.

Furthermore, the central main fuel lance is preferably arranged in the center of the burner, preferably along its full length, particularly wherein the remaining conduits of the burner are arranged concentrically around the central main fuel lance.

The central main fuel lance preferably further comprises a main fuel connector.

In generally preferred embodiments herein, the burner is configured so that the main fuel velocity at the main fuel outlet is less than 140 ft/s and in particular less than 120 ft/s. In further embodiments, the main fuel exit velocity herein is less than 100 ft/s, such as in the range from 80 ft/s to 100 ft/s. Accordingly, in generally preferred embodiments herein, the burner is configured so that the main fuel velocity at the main fuel outlet is in the range from 80 ft/s to 140 ft/s.

In specific embodiments herein, a velocity of the liquid fuel/oxidant mixture helps the spray to get engulfed by the recirculation zone setup by the air swirler. This advantageously avoids potential issues of the spray (if the momentum would be too high) interfering with the development of a proper recirculation zone and resulting in an increase in the length of the flame.

As indicated above, in the present invention, the main fuel is a liquid fuel. As non-limiting particular embodiments, the liquid fuel may be selected from the group consisting of #2 fuel oil, #6 fuel oil, Naptha, coal-water slurries, and any suitable waste liquid, all of which are readily known to the skilled person.

Further as to the pilot fuel conduit, same preferably further comprises a pilot fuel connector.

In certain embodiments, said pilot fuel conduit is designated as a "pipe 1", which is a gaseous fuel pipe.

Preferably herein, the pilot fuel conduit comprises a plurality of exit holes. Such "exit holes" are holes comprised in the pilot fuel outlet through which the pilot fuel exits from the pilot fuel conduit.

Herein, the diameter of the fuel exit holes (22) may be defined as P0. Preferably, P0/D1 is between 0.02 and 0.2.

Preferably, the outlet plane defined by said exit holes corresponds to the outlet plane of the pilot fuel outlet.

Preferably, said exit holes are arranged to surround the central main fuel lance, preferably in equal distances to each other and in fixed spaced relation to the central main fuel lance.

Herein, the circumferential angle defined by the main axis (4) of the burner and the centers of two adjacent primary fuel exit holes (22) may be defined as angle theta. In preferred embodiments herein, angle theta is from 10 to 50 degrees.

Without intending to be bound by theory, a lower range helps to separate the holes such that they are not too close to cause fuel rich regions and prevent from air—fuel mixing—and a higher range prevents the holes from being too far and ensures there is enough coupling between two jets to provide coupling effect of heat release from each jet for stable combustion.

In preferred embodiments, the pilot fuel exit plate (23) has a porosity (defined by the total open area on the plate that allows the fuel to flow divided by cross-section area of the plate) in the range of 2% to 25%.

Further as to the auxiliary oxidant conduit, in certain embodiments, same is designated as a "pipe 2", which particularly is an air pipe.

The auxiliary oxidant conduit preferably further comprises an auxiliary oxidant connector.

In certain embodiments herein, the auxiliary oxidant conduit further comprises air purge holes. Preferably, said air purge holes allow the passage of oxidant between the main and auxiliary oxidant conduits.

Further as to the main oxidant conduit, same preferably further comprises a main oxidant connector.

In certain embodiments, the main oxidant conduit is designated as a "pipe 3", particularly as an air pipe.

Preferably the main oxidant conduit further comprises a swirler section.

Preferably, the swirler section is located upstream of the main oxidant outlet.

Preferably herein, the swirl angle is from 5 to 60 degrees. Depending on the firing rate and length of flame that is needed or desirable, respectively, the swirl angle may be set between 30 to 45 degrees. In particular embodiments, the swirl angle is from 30 to 42 degrees.

As used herein, a "swirl angle" is defined to be the angle between the swirler blades and the plane parallel to the main axis of the burner.

Preferably herein, the strength of the swirl imparted to the fluid may be quantified by the Swirl number S, defined as the ratio of the axial flux of the angular momentum $G\varphi$ to the product of the axial thrust Gx and the exit radius R of the burner nozzle. When $S=G\varphi/G\times R$ is less than 0.6, the fluid is in the weak swirl regime, and when S is greater than 0.6 the fluid is in the strong swirl regime. The swirl number is preferably in the range from 0.1 to 1.5. This swirl number or strength can be produced by using either axial or radial or tangential swirler.

The swirler section may be configured such that air introduced into the swirler section induces a tangential flow field in the combustion chamber, particularly wherein i) the rate of mixing among the air, main fuel and secondary fuel is increased, and/or ii) a compact flame is created that fits within the short reaction chamber.

In certain preferred embodiments, the main oxidant conduit further comprises bleed holes. As used herein, said bleed holes allow passage of a part of the main oxidant during operation of the burner.

Preferably herein, the bleed holes are comprised within a bleed hole annulus.

In preferred embodiments, the main oxidant conduit comprises both a swirler section and a bleed hole annulus comprising bleed holes.

In certain embodiments, the bleed hole annulus exit has a 'purge air plate' (47), which has a porosity (defined by the total open area on the plate that allows the air to flow divided by cross-section area of the plate) in limit of 2% to 15%.

In particular embodiments, the bleed holes (and preferably said bleed hole annulus comprising said bleed holes) is arranged next to the swirler section such that the main oxidant is able to pass through both the bleed holes and the swirler section.

In certain embodiments, herein, the diameter of the bleed holes (43) may be defined as P1. Preferably, P1/D1 is between 0.02 and 0.2

Preferably, said bleed hole annulus is arranged in fixed spatial relation between the outermost in radial direction of pilot fuel conduit wall and auxiliary oxidant conduit wall and the swirler section.

Further as to the secondary fuel conduit, same preferably further comprises a secondary fuel connector.

In certain embodiments, said secondary fuel conduit is designated as a "pipe 4", which particularly is a gaseous fuel pipe.

In preferred embodiments herein, the secondary fuel conduit comprises a turbulence generator, which may also be referred to herein as means for generating turbulences or turbulence generator means, respectively. Same may comprise one or more turbulence generator disk(s) or turbulence generator plates, respectively. Preferably, said turbulence generator means are arranged at an additional wall of the secondary fuel conduit, which is positioned next to the wall of the main oxidant conduit.

Without intending to be bound by theory, as to turbulence generation, the present inventors note that in furnace or vessel that is short in volume, it may be important to achieve complete combustion of the fuels within a short distance. To increase the turbulence intensity in the secondary fuel (such as the tailgas mixture), a turbulence generator disk may be introduced in the tailgas stream. This disk creates eddies that help to increase the turbulence intensity of the tailgas stream. The higher turbulence intensity helps in enhanced mixing of fuel and oxidant, thereby helping in combusting the tailgas mixture in shorter downstream location.

Preferably herein, where a secondary fuel conduit is present, the conduit end plane of the secondary fuel conduit is defined as the "hot face" of the burner.

The secondary fuel conduit can take any form as known to people familiar with the art. The secondary fuel conduit can be located radially away from the main oxidant conduit.

Additionally, the secondary fuel conduit can be in the form several pipes located in a concentric manner at a fixed radial location with respect to the outer diameter of the main oxidant pipe. Furthermore, these pipes can be arranged in concentric manner in several rings at different radial location around the main oxidant pipe.

In preferred embodiments herein, the outlet plane of the pilot fuel outlet is recessed in upstream direction from the outlet plane of the main fuel outlet by a distance L1.

In related embodiments, the outlet plane of the exit holes is recessed in upstream direction from outlet plane of main fuel outlet by a distance L1.

In preferred embodiments of the invention, the outlet plane of the innermost in radial direction of pilot fuel conduit and auxiliary oxidant conduit (which is preferably the pilot fuel conduit) is recessed in upstream direction from the outlet plane of the main oxidant conduit by a distance L1.

In certain embodiments, both the outlet plane of the pilot fuel conduit and the outlet plane of the auxiliary oxidant conduit are recessed in upstream direction from the outlet plane of the main oxidant conduit by a distance L1.

In preferred embodiments of the invention, the conduit end plane of the auxiliary oxidant conduit is recessed in upstream direction from the conduit end plane of the main oxidant conduit by a distance L2.

In preferred embodiments of the invention, the conduit end plane of the main oxidant conduit is recessed in upstream direction from conduit end plane of the secondary fuel conduit by a distance L3.

In preferred embodiments of the invention, the fuel tube is recessed by L2+L3 length. This is considered advantageous in order to allow the pilot air stream to develop an envelope around the liquid fuel lance before it comes out of the HOT face of the burner. Without intending to be bound by theory, this helps to keep the oil lance cool when the liquid fuel is shut off by preventing the hot gases from the swirl recirculation zone from impinging the exit of the oil lance.

As used herein, an "outlet plane" of a given conduit designates a plane defined in direction perpendicular to the main axis of the conduit at a downstream location where the fuel or oxidant respectively is no longer restricted by two walls.

Likewise, the "outlet plane" of the central main fuel lance designates a plane defined in direction perpendicular to the main axis of the conduit at a downstream location where the main fuel is no longer restricted by two walls. The same applies as to the central lance.

As used herein, a "conduit end plane" of a given conduit designates a plane defined in direction perpendicular to the main axis of the conduit at the downstream end of the conduit.

Likewise, the "conduit end plane" (central lance end plane or suchlike terms) of the central main fuel lance designates a plane defined in direction perpendicular to the main axis of the conduit at the downstream end of the main fuel outlet. In case of the central main fuel lance, the conduit end plane corresponds to its outlet plane.

In preferred embodiments herein, the conduit end plane of the main fuel conduit lies further downstream than the conduit end plane of the pilot fuel conduit-preferably separated by a distance L1.

In preferred embodiments herein, the conduit end plane of the auxiliary oxidant conduit lies further downstream than the outlet plane of the auxiliary oxidant conduit-preferably separated by a distance L1.

In preferred embodiments, the conduit end plane of the main oxidant conduit lies further downstream than the outlet plane of the main oxidant conduit-preferably separated by a distance L2.

Likewise, in preferred embodiments, the conduit end plane of the main oxidant conduit lies further downstream than the conduit end plane of the auxiliary oxidant conduit—preferably separated by a distance L2.

In preferred embodiments herein, the conduit end plane of the secondary fuel conduit lies further downstream than the outlet plane of the secondary fuel conduit-preferably separated by a distance L3.

Likewise, in preferred embodiments, the conduit end plane of the secondary fuel conduit lies further downstream than the conduit end plane of the main oxidant conduit-preferably separated by a distance L3.

In preferred embodiments of the invention, the central main fuel lance wall has an outer diameter D1.

In preferred embodiments of the invention, the innermost in radial direction of pilot fuel conduit wall and auxiliary oxidant conduit wall has an outer diameter D2. More preferably, the pilot fuel conduit wall has an outer diameter D2.

In preferred embodiments of the invention, the outermost in radial direction of pilot fuel conduit wall and auxiliary oxidant conduit wall has an inner diameter D3. More preferably, the auxiliary oxidant conduit has an inner diameter D3.

In preferred embodiments of the invention, the outer wall of the main oxidant conduit has an inner diameter D4.

In addition, in preferred embodiments of the invention, the outer wall of the secondary fuel conduit has an outer diameter D5.

According to preferred embodiments herein, the sizes of the said diameters (or diameters, respectively) are D1<D2<D3<D4, preferably D1<D2<D3<D4<D5.

In other embodiments herein, the said sizes are D1<D3<D2<D4, preferably D1<D3<D2<D4<D5.

In certain embodiments herein, D2/D1 is between 1 and 2.5, particularly between 1.7 and 2.2.

In certain embodiments herein, D3/D1 is between 2 and 4, particularly between 2.5 and 3.3.

In certain embodiments herein, D4/D1 is between 3.5 and 6.5, particularly between 4.5 and 6.

In certain embodiments herein, D5/D1 is between 5.0 and 10.0, particularly between 5.6 and 7.4.

In particular embodiments herein, D2/D1 is between 1 and 2.5, more preferably between 1.7 and 2.2; D3/D1 is between 2 and 4, more preferably between 2.5 and 3.3; D4/D1 is between 3.5 and 6.5, more preferably between 4.5 and 6; and D5/D1 is between 5 and 10, more preferably between 5.6 and 7.4.

Preferably herein, L1/D1 is between 0.5 and 15, more preferably between 1.0 and 10, more preferably, between 1.5 and 4.

Preferably herein, L2/D2 is between 0.05 and 10, more preferably between 0.07 and 2, more preferably between 0.1 and 0.5.

Preferably herein, L3/D3 is between 0.05 and 10, more preferably between 0.07 and 2, more preferably between 0.1 and 0.5.

In certain particular embodiments herein, L1/D1 is between 1.0 and 10, more preferably between 1.5 and 4; L2/D2 is between 0.05 and 10, more preferably between 0.1 and 0.5, and L3/D3 is between 0.05 and 10, more preferably between 0.1 and 0.5.

In alternative embodiments herein corresponding to any of those above, each of the said diameter D1, D2, D3 and D4 corresponds to an outer diameter.

In preferred embodiments herein, the conduit end plane of the main fuel lance is essentially at the same downstream position as the conduit end plane of the outermost in radial direction of pilot fuel conduit and auxiliary oxidant conduit.

Generally herein, and as is self-evident, the main and auxiliary oxidants comprises oxygen. Said oxygen is preferably comprised in the main and/or auxiliary oxidant in an amount of from 15 to 30% by volume. In particular preferred embodiments, the main and auxiliary oxidant is air. In the art, air is generally known to comprise about 20.9% by volume oxygen.

Consequently, the burners of the invention may advantageously use air as the oxidants, which is regarded a readily available/cheap source of oxidant.

Furthermore, in case both oxidants are the same (such as preferably air), the main oxidant conduit and the auxiliary oxidant conduit may both be connected to the same oxidant supply.

Preferably, said conduits are both connected to the same oxidant supply using a control valve. Hence, in particular embodiments, an oxidant such as air required to combust this pilot gaseous fuel is supplied through a diversion valve from the main air supply to the burner or a separate airline.

In a certain embodiment herein, the volumetric flow rate of the auxiliary oxidant is about 5-20% of the total oxidant flow rate of the burner.

In certain embodiments, in one particular conduit, the volumetric flow rate of any fluid is divided amongst different outlets by correlating an individual exit cross-section area with the total exit cross-sectional area for that conduit. In doing so, the pressure of the fluid and pressure differential between two adjacent conduits are important criteria to determine the directional flow of fluid.

Further embodiments herein may be defined by areas of various holes and outlets. That is, for example in a sample area notation for oxidizer conduit, the cross-sectional area of air purge holes (37), and oxidant section outlet (42) may be defined as A0, and A1. Preferably, A0 is 5 to 20% of (A0+A1).

Accordingly, about 5-20% of the main oxidant (e.g. primary air) may be supplied through the pilot burner flame. In certain preferred embodiments, this air continues to flow in the gap between the swirl air and the liquid fuel conduit when the pilot burner fuel is shut-off.

Without intending to limit the present features in any way, and as will be readily understood by the person skilled in the art, the pilot fuel conduit and the auxiliary oxidant conduit herein may be described (and/or considered) as a pilot burner for the burner of the present invention.

Consequently, the auxiliary oxidant herein may also be designated as "pilot air". Nevertheless, the said air may additionally be used for other purposes as described herein.

Generally, a "pilot burner" is understood as a burner for initially igniting the main fuel. Accordingly, the pilot burner is preferably used for igniting the main fuel.

Once the (main) burner is ignited by using the said pilot burner, the said pilot burner may be shut off again by shutting off the pilot fuel conduit. As opposed to the pilot fuel conduit, the auxiliary oxidant conduit is preferably not shut off, but is instead used as an oxidant for the main fuel. Accordingly, the auxiliary oxidant conduit is preferably configured to supply oxidant to the central main fuel lance such as after the pilot burner has been shut off.

In further detail, in non-limiting embodiments, the pilot flame provides a small thermal output: about 10% of the main firing rate of the liquid fuel burner at the start-up. Generally, the pilot flame may be used only during the start of the burner operation to ignite the main liquid fuel. Accordingly, the pilot flame may be turned off when the liquid fuel has been ignited without causing any liquid primary flame blowoff or damage to the burner. In certain embodiments, the pilot fuel conduit 1 may be recessed by length L1 from the central main fuel lance (e.g. oil lance 1). The recess, L1 helps to partially premix the pilot fuel and auxiliary oxidant (pilot air) that helps to better stabilize the pilot flame and is not affected adversely by the swirling air flow.

Generally herein, the person skilled in the art will readily be in a position to suitably adjust the velocities of the oxidants and fuels during operation of the burners of the invention.

In particular embodiments herein, the burner is configured in such a way that the velocity of the main fuel is less than 140 ft/s, preferably less than 120 ft/s.

In particular embodiments herein, the burner is configured in such a way that the velocity of the main oxidant is between 20 ft/s and 200 ft/s, particularly between 40 ft/s and 140 ft/s. However, if the available pressure is high the velocity may readily be as high as 200-300 ft/s.

Without intending to be bound by theory, the maximum attainable main oxidant (preferably air) velocity is typically determined by the available pressure from the air blower. The present inventors found that these velocities along with appropriate swirl angle provides sufficient mixing of the air with the two fuels and maintains a stable flame over a wide range of burner operations even in a cold furnace.

Generally herein, if not particularly specified otherwise, a given velocity refers to the velocity of the oxidant/fuel at the outlet of its given conduit.

In particular embodiments herein, the burner is configured in such a way that the velocity of the auxiliary oxidant is between 10 ft/s and 80 ft/s, particularly between 20 ft/s and 40 ft/s.

Without intending to be bound by theory, the velocity of pilot/auxillary oxidizer is typically kept low such that the air provides enough momentum to avoid any back flow of hot gases towards the pilot fuel pipe. The high limit is determined such that the momentum is not high enough that it starts to adversely impact the recirculation zones of the air swirler.

In particular embodiments herein, the burner is configured in such a way that the velocity of the secondary fuel is between 20 ft/s and 200 ft/s, particularly between 40 ft/s and 120 ft/s.

Without intending to be bound by theory, the velocity of the secondary fuel is determined such that it provides sufficient mixing with the swirling air thereby enabling a stable flame. Secondary fuel velocity that is below the low velocity limit can result in unreacted fuel collecting near the furnace wall. This fuel can subsequently combust there causing over-heating of the reformer top wall.

In particular embodiments herein, the burner is configured in such a way that the velocity of the pilot fuel at the exit of fuel exit holes is between 30 ft/s and 250 ft/s, particularly between 60 ft/s and 120 ft/s.

Preferably, the velocity ratio of pilot fuel and auxiliary oxidant is kept in the range of 1.5 and 3.0.

Without intending to be bound by theory, the velocity of pilot fuel is determined to significantly contribute to the ability quickly mix the fuel with surrounding air. The velocity range and velocity ratio of pilot fuel and auxiliary oxidant provides a stable flame.

In a certain embodiment herein, the burner is configured in such a way that the thermal output of the pilot fuel, is about 5-15% of the thermal output of the main fuel at a start-up condition, wherein the main fuel preferably is a liquid fuel.

In a certain embodiment herein, the burner is configured in such a way that the start-up total thermal output of the burner is provided by the main fuel to 100%, wherein the main fuel preferably is a liquid fuel.

In a certain embodiment herein, the burner is configured in such a way that, during normal operation, the thermal output of the main fuel is 0-40% of the total thermal output of the burner.

In general preferred embodiments herein each of the conduits defined for the burner is configured as a pipe, particularly as a pipe having a substantially round cross-section, wherein all the said conduits may be arranged essentially concentrically.

Similarly, each of the conduits may have a substantially round cross-section, and they may all be arranged essentially concentrically.

Preferably herein, all of the said conduits share a common central axis. Preferably herein, all of the said conduits are concentrically disposed around a common longitudinal axis. Likewise, preferably herein, all conduits are concentrically disposed around a common longitudinal axis. Preferably herein, all of the said conduits are essentially straight.

In particular embodiments herein, the central main fuel lance is longer than the pilot fuel conduit, wherein the pilot fuel conduit is longer than the auxiliary oxidant conduit, wherein the auxiliary oxidant conduit is longer than the main oxidant conduit, and wherein the main oxidant conduit is longer than the secondary fuel conduit.

Generally herein, advantageous characteristics of the present invention include the following, all of which correspond to other preferred embodiments of the first aspect:

- The burner of the first aspect may achieve reducing the flame length, in particular for keeping the flame length in a furnace smaller than the furnace length.
- The burner of the first aspect may achieve avoiding the use of an external pilot burner. (No need of external pilot burners as is typically the case for liquid fuel burners). Instead, a mechanism for liquid fuel ignition is included as part of the main burner.
- The burner of the first aspect may achieve improving the function of a burner comprising a pilot burner that is not configured as the pilot fuel conduit and auxiliary oxidant conduit as defined in any of the preceding items.
- The burner of the first aspect may achieve reliable start-up in a cold furnace and pilot flame can be turned OFF as needed after main liquid flame lights.
- The burner of the first aspect may achieve more intimate mixing from combined swirl leading to shorter flame that fits inside a compact/short reformer/furnace/combustion chamber.
- The burner of the first aspect may achieve low back pressure of primary oxidant (e.g. combustion air) and secondary fuel (e.g. tailgas), which may lower the power requirement of any compression devide or eliminate the need of any secondary compression device.
- The burner of the first aspect may achieve that the back pressure of the main oxidant (e.g. primary air) and the tailgas stream are low enough that it doesn't need any secondary compressor device to increase the supply pressure. This particularly enables to reduce the operational cost of the compressors, as are required by certain burners available in the market.
- The burner of the first aspect may achieve use of a single air stream to combust both fuels, which can help to reduce the overall cost of the burner and, optionally, of skids, diverter valves, and/or any complex controller mechanism.
- The burner of the first aspect may be characterized by a fuel lean stable flame without flame blow-off at high excess air (equivalence ratio of as low as 0.25)
- The burner of the first aspect may achieve advantageous operation aspects selected from the group consisting of start-up, introduction of tailgas, better turndown, and wider range of stable operation.
- The burner of the first aspect includes a pilot burner that can assist, if required, to help in lower turndowns using liquid fuel.
- The burner of the first aspect includes a pilot burner that can assist, if required, to help in combustion of hard to combust liquid fuels (e.g, fuels that are viscous and/or of low Btu value).
- The burner of the first aspect may achieve operation without damage to the burner, when the pilot burner is turned off.
- The burner of the first aspect may achieve a pilot air to prevent any back flow of air back inside the pilot fuel pipe.
- In the burner of the first aspect, use of a liquid fuel atomization nozzle which is an air or any gas assisted atomized nozzle, facilitates to achieve firing rate turndown ratio on the liquid fuel lance.

The burner of the first aspect may be characterized in flexibility in burner operation across wide range of split of total heat/energy coming from primary vs secondary fuel. This includes about 5% to 100% total thermal output coming from primary fuel and balance from the secondary fuel.

In a second aspect of the invention, there is provided a furnace comprising a burner according to the first aspect of the invention.

Preferred embodiments of the furnaces of the invention correspond to the embodiments of the burners of the invention described above. Hence, preferably, the furnace is further defined in line with any of the above embodiments of the burner as described in context with the first aspect.

This includes embodiments relating to the above described advantages of the burner of the first aspect, which are also envisaged herein regarding respective furnaces of the second aspect.

In certain preferred embodiments, the furnace is selected from the group consisting of a furnace for steam methane reforming, a reheat furnace in steel industries, and a secondary melting furnace.

In a third aspect of the invention, there is provided a method for operating a burner of the first aspect and/or for operating a furnace of the second aspect. Said method is not particularly limited as will readily be appreciated by the skilled person.

In certain embodiments, the method comprises the steps of i) starting the burner using the pilot fuel, wherein the pilot fuel is a gaseous fuel, and ii) providing and igniting the main fuel, wherein the main fuel is a liquid fuel.

Preferably, the method further comprises a step of iii) closing the flow of the pilot fuel, particularly wherein said flow is closed after the main fuel has been ignited.

Generally, the method preferably additionally comprises further providing and igniting the secondary fuel. Said secondary fuel may be provided once it becomes available during an industrial process.

In certain embodiments, the method comprises a further step of providing and combusting the pilot fuel again, preferably to keep the flame of the main fuel stable.

Generally, further preferred embodiments of the methods of the invention correspond to the embodiments of the burners of the invention described above, wherein the burner used in the method is further defined by further product features. In other words, preferably, the methods of the invention are further defined in line with any of the above embodiments of the burner as described in context with the first aspect.

Moreover, even further preferred embodiments of the methods of the invention involve further method features that are based on any features described above in context with the burners of the invention.

For example, in preferred embodiments of the methods herein, the main fuel employed in the method is a liquid fuel and/or the pilot fuel employed in the method is a gaseous fuel; preferably the main fuel employed in the method is a liquid fuel, the secondary fuel employed in the method is a gaseous fuel, and the pilot fuel employed in the method is a gaseous fuel.

In particular embodiments of the third aspect, the secondary fuel is tailgas. In particular embodiments of the third aspect, the secondary fuel results from industrial processes. In particular embodiments of the third aspect, the secondary fuel is a process gas.

In particular embodiments of the third aspect, the secondary fuel is selected from the group consisting of PSA waste gas, syngas, and a $H_2/CO/CO_2/CH_4$ mixture.

Moreover, in the present methods, the main and auxiliary oxidants employed in the method preferably comprise oxygen in the main and/or auxiliary oxidant in an amount of from 15 to 30% by volume. In particular preferred embodiments, the main and auxiliary oxidant employed in the method is air. In the art, air is generally known to comprise about 20.9% by volume oxygen. Consequently, the methods of the invention may advantageously use air as the oxidants.

Furthermore, in certain embodiments of the methods, the volumetric flow rate of the auxiliary oxidant is about 5-20% of the total oxidant flow rate of the burner. Accordingly, preferably about 5-20% of primary oxidant (such as primary air) are supplied through the pilot burner flame. In certain preferred embodiments, this air continues to flow in the gap between the swirl air and the liquid fuel conduit when the pilot burner fuel is shut-off.

As further examples, in preferred embodiments of the third aspect, the pilot fuel and/or the main oxidant, and/or the auxiliary oxidant, and/or the secondary fuel-preferably at least the pilot fuel, more preferably at least the pilot fuel and the auxiliary oxidant-flow(s) through an annulus. Said annuli may further be characterized by containing further elements of the respective conduits (such as exit holes, bleed holes, a swirler section and suchlike) as defined elsewhere herein.

Moreover, in particular embodiments of the methods of the invention, the velocity of the main fuel is less than 140 ft/s, preferably less than 120 ft/s.

In particular embodiments of the methods of the invention, the velocity of the main oxidant is between 20 ft/s and 200 ft/s, particularly between 40 ft/s and 140 ft/s. However, if the available pressure is high, the velocity may readily be as high as 200-300 ft/s.

In particular embodiments of the methods of the invention, the velocity of the auxiliary oxidant is between 10 ft/s and 80 ft/s, particularly between 20 ft/s and 40 ft/s.

In particular embodiments of the methods of the invention, the velocity of the secondary fuel is between 20 ft/s and 200 ft/s, particularly between 40 ft/s and 120 ft/s.

In particular embodiments of the methods of the invention, the velocity of the pilot fuel is between 30 ft/s and 250 ft/s, particularly between 60 ft/s and 120 ft/s.

In particular embodiments of the methods of the invention, the thermal output of the pilot fuel, is about 5-15% of the thermal output of the main fuel at a start-up condition, wherein the main fuel preferably is a liquid fuel.

In particular embodiments of the methods of the invention, the start-up total thermal output of the burner is provided by the main fuel to 100%, wherein the main fuel preferably is a liquid fuel.

In particular embodiments of the methods of the invention, during normal operation, the thermal output of the main fuel is 0-40% of the total thermal output of the burner.

Moreover, advantages of the present invention include the following, all of which correspond to further preferred embodiments of the third aspect:

The method of the third aspect may achieve reducing the flame length, in particular for keeping the flame length in a furnace smaller than the furnace length.

The method of the third aspect may achieve avoiding the use of an external pilot burner. (No need of external pilot burners as is typically the case for liquid fuel burners). Instead, a mechanism for liquid fuel ignition is included as part of the main burner.

The method of the third aspect may achieve improving the function of a burner comprising a pilot burner that is not configured as the pilot fuel conduit and auxiliary oxidant conduit as defined in any of the preceding items.

The method of the third aspect may achieve reliable start-up in a cold furnace and pilot flame can be turned OFF as needed after main liquid flame lights.

The method of the third aspect may achieve more intimate mixing from combined swirl leading to shorter flame that fits inside a compact/short reformer/furnace/combustion chamber.

The method of the third aspect may achieve low back pressure of combustion air and tailgas, which may eliminate the need of any secondary compression device.

The method of the third aspect may achieve that the back pressure of the primary oxidant (such as primary air) and the secondary fuel (e.g. tailgas) stream are low enough that it doesn't need any compressor device to increase the supply pressure. This particularly enables to reduce the operational cost of the compressors, as are required by certain burners available in the market.

The method of the third aspect may achieve use of a single air stream to combust both fuels, which can help to reduce the overall cost of the burner and, optionally, of skids, diverter valves, and/or any complex controller mechanism.

The method of the third aspect may achieve advantageous operation aspects selected from the group consisting of start-up, introduction of tailgas, better turndown, and wider range of stable operation.

The method of the third aspect may include use of a pilot burner that can assist, if required, to help in lower turndowns using liquid fuel.

The method of the third aspect may include use of a pilot burner that can optionally assist, if required, to help in combustion of hard to combust liquid fuels.

The method of the third aspect may achieve operation without damage to the burner, when the pilot burner is turned off.

The method of the third aspect may establish a pilot air flame to prevent any back flow of air back inside the pilot fuel pipe.

Generally herein, preferred embodiments of any of the second to fourth aspects correspond to preferred embodiments of the first aspect herein.

Furthermore, the articles "a" and "an" as used herein mean one or more when applied to any feature in embodiments of the present invention described in the specification and claims. The use of "a" and "an" does not limit the meaning to a single feature unless such a limit is specifically stated. The article "the" preceding singular or plural nouns or noun phrases denotes a particular specified feature or particular specified features and may have a singular or plural connotation depending upon the context in which it is used. The adjective "any" means one, some, or all indiscriminately of whatever quantity.

Moreover, generally herein, if a certain embodiment is described by using the term "comprising" or suchlike terms, further embodiments are envisaged herein as well, which are described by using the term "consisting of" or suchlike terms instead of the said term "comprising" or suchlike terms.

FURTHER PARTICULAR EMBODIMENTS

The present invention particularly also relates to the following items:

Item 1: A burner (1), comprising a central main fuel lance (10) for supply of an atomized liquid fuel having a main fuel outlet (14) at its downstream end, a main oxidant conduit (40) for supply of a main oxidant, having a main oxidant outlet (44) at its downstream end, a pilot fuel conduit (20) for supply of a gaseous pilot fuel, having a pilot fuel outlet (24) at its downstream end, and an auxiliary oxidant conduit (30) for supply of an auxiliary oxidant, having an auxiliary oxidant outlet (34) at its downstream end, wherein at least in the downstream portion (5) of the burner (1), in which main fuel outlet (14), main oxidant outlet (44), pilot fuel outlet (24) and auxiliary oxidant outlet (34) are present, the pilot fuel conduit (20), the auxiliary oxidant conduit (30) and the main oxidant conduit (40) are arranged concentrically around the central main fuel lance (10) so that central main fuel lance (10) is surrounded by the pilot fuel conduit (20), the auxiliary oxidant conduit (30) and the main oxidant conduit (40), wherein at least in said downstream portion (5) of the burner (1) the central main fuel lance (10), the pilot fuel conduit (20) and the auxiliary oxidant conduit (30) are surrounded by the main oxidant conduit (40), and wherein means for igniting (65) the pilot fuel are optionally present upstream the main fuel outlet (14) inside the pilot fuel conduit (20) and/or the auxiliary oxidant conduit (30).

Item 2: The burner (1) of item 1 further comprising a secondary fuel conduit (50) for supply of a secondary fuel, having a secondary fuel outlet (54) at its downstream end, wherein at least in the downstream portion (5) of the burner (1), in which main fuel outlet, main oxidant outlet, pilot fuel outlet (24) and auxiliary oxidant outlet are present, the secondary fuel conduit is arranged concentrically around the central main fuel lance (10), and wherein at least in said downstream portion (5) of the burner (1) the central main fuel lance (10), the pilot fuel conduit (20), the auxiliary oxidant conduit (30) and the main oxidant conduit (40) are surrounded by the secondary fuel conduit.

Item 3: The burner (1) of item 1, wherein at least in said downstream portion (5) of the burner (1) the central main fuel lance (10), and the pilot fuel conduit (20) are surrounded by the auxiliary oxidant conduit (30).

Item 4: A burner (1) comprising a central main fuel lance (10) for supply of an atomized liquid fuel, a main oxidant conduit (40) for supply of a main oxidant, a pilot fuel conduit (20) for supply of a gaseous pilot fuel, and an auxiliary oxidant conduit (30) for supply of an auxiliary oxidant, wherein at least in a terminating portion of the burner (1) comprising at least 20% of the length of the burner (1), the pilot fuel conduit (20), the auxiliary oxidant conduit (30) and the main oxidant conduit (40) are arranged concentrically around the central main fuel lance (10) so that central main fuel lance (10) is surrounded by the pilot fuel conduit (20), the auxiliary oxidant conduit (30) and the main oxidant conduit (40), wherein at least in said terminating portion of the burner (1) the central main fuel lance (10), the pilot fuel conduit (20) and the auxiliary oxidant conduit (30) are surrounded by the main oxidant conduit (40), and wherein means for igniting (65) the pilot fuel are optionally present upstream the main fuel outlet inside the pilot fuel conduit (20) and/or the auxiliary oxidant conduit (30).

Item 5: The burner (1) of item 4, wherein said burner (1) further comprises a secondary fuel conduit (50) for supply of a secondary fuel, wherein at least in said terminating portion of the burner (1), the secondary fuel conduit (50) is arranged concentrically around the central main fuel lance (10), and wherein at least in said terminating portion of the burner (1) the central main fuel lance (10), the pilot fuel conduit (20), the auxiliary oxidant conduit (30) and the main oxidant conduit (40) are surrounded by the secondary fuel conduit (50).

Item 6: A burner (1), comprising a central main fuel lance (10) for a main fuel and a main oxidant conduit (40) for a main oxidant, wherein the central main fuel lance (10) is essentially positioned (preferably concentrically) within the main oxidant conduit (40); characterized in that the burner (1) further comprises a pilot fuel conduit (20) for a pilot fuel, and an auxiliary oxidant conduit (30) for an auxiliary oxidant, wherein the pilot fuel conduit (20) and the downstream portion (5) of the auxiliary oxidant conduit (30) are positioned (preferably concentrically) within the main oxidant conduit (40).

Item 7: The burner (1) of item 6, wherein the burner (1) additionally comprises a secondary fuel conduit (50) for a secondary fuel, wherein the main oxidant conduit (40) is positioned (preferably concentrically) within the secondary fuel conduit (50).

Item 8: The burner (1) according to any one of the preceding items wherein the main oxidant conduit (40) in said downstream section (5) of the burner (1) comprises a swirler section (42) upstream of the main oxidant outlet.

Item 9: The burner (1) according to any one of the preceding items, a) wherein the auxiliary oxidant conduit (30) further comprises air purge holes (37), preferably wherein said air purge holes (37) are present upstream of the swirler section (42), and/or b) wherein the pilot fuel conduit (20) exit further comprises a series of small exit holes (22), especially wherein said exit holes (22) are arranged in fixed spatial location to create jets of pilot fuel.

Item 10: The burner (1) according to any one of the preceding items, wherein a) the central main fuel lance (10) is an air or another gas assisted atomization nozzle and/or b) wherein the secondary fuel conduit (50) comprises a turbulence generator (57) upstream of its outlet plane (55), preferably immediately uppstream of its outlet plane (55).

Item 11: The burner (1) according to any one of the preceding items wherein the outlet plane (25) of the pilot fuel outlet (24) is recessed in upstream direction from outlet plane (15) of the main fuel outlet (14) by a distance L1.

Item 12: The burner (1) according to item 11, wherein central main fuel lance (10) wall has an outer diameter D1.

Item 13: The burner (1) according to item 12, wherein L1/D1 is between 0.5 and 15.

Item 14: The burner (1) according to item 13, wherein L1/D1 is between 1.0 and 10.

Item 15: The burner (1) according to item 14, wherein L1/D1 is between 1.5 and 4.

Item 16: The burner (1) according to any one of the preceding items, wherein the conduit end plane of the auxiliary oxidant conduit is recessed in upstream direction from the conduit end plane of the main oxidant conduit by a distance L2.

Item 17: The burner (1) according to any one of the preceding items, wherein the innermost in radial direction of pilot fuel conduit wall (29) and auxiliary oxidant conduit wall (39), which preferably is the pilot fuel conduit wall (29), has an outer diameter D2.

Item 18: The burner (1) according to item 17, wherein L2/D2 is between 0.05 and 10, preferably between 0.1 and 10.

Item 19: The burner (1) according to item 18, wherein L2/D2 is between 0.07 and 2, preferably between 0.1 and 2.

Item 20: The burner (1) according to item 19, wherein L2/D2 is between 0.1 and 0.5.

Item 21: The burner (1) according to any one of the preceding items, wherein conduit end plane (46) of the main oxidant conduit (40) is recessed in upstream direction from conduit end plane (56) of the secondary fuel conduit (50) by a distance L3.

Item 22: The burner (1) according to any one of the preceding items, wherein the outermost in radial direction of pilot fuel conduit wall (29) and auxiliary oxidant conduit wall (39), which preferably is the auxiliary oxidant conduit wall (39), has an inner diameter D3.

Item 23: The burner (1) according to item 22, wherein L3/D3 is between 0.05 and 10, preferably between 0.1 and 10.

Item 24: The burner (1) according to item 23, wherein L3/D3 is between 0.07 and 2, preferably between 0.1 and 2.

Item 25: The burner (1) according to item 24, wherein L3/D3 is between 0.1 and 0.5.

Item 26: The burner (1) according to any one of the preceding items wherein the conduit end plane (16) of the main fuel lance (10) is essentially at the same downstream position as the conduit end plane (36) of the outermost in radial direction of pilot fuel conduit (20) and auxiliary oxidant conduit (30).

Item 27: The burner (1) according to any one of the preceding items wherein the central main fuel lance wall (19) has an outer diameter D1, the innermost in radial direction of pilot fuel conduit wall (29) and auxiliary oxidant conduit wall (39) has an outer diameter D2, the outermost in radial direction of pilot fuel conduit wall (29) and auxiliary oxidant conduit wall (39) has an inner diameter D3, and the outer wall (49) of the main oxidant conduit (40) has an inner diameter D4.

Item 28: The burner (1) of any one of items 1 to 26, wherein the central main fuel lance (10) has a diameter D1, and/or the main oxidant conduit (40) has a diameter D4, and/or the secondary fuel conduit (50) has a diameter D5, and/or the pilot fuel conduit (20) has a diameter D2, and/or the auxiliary oxidant conduit (30) has a diameter D3.

Item 29: The burner (1) of item 28, wherein the central main fuel lance (10) has a diameter D1, and the main oxidant conduit (40) has a diameter D4, and the secondary fuel conduit (50) has a diameter D5, and the pilot fuel conduit (20) has a diameter D2, and the auxiliary oxidant conduit (30) has a diameter D3.

Item 30: The burner (1) of item 28 or 29, wherein each of the said diameters is an outer diameter.

Item 31: The burner (1) of any one of the preceding items, wherein D1<D2<D3<D4, preferably wherein D1<D2<D3<D4<D5.

Item 32: The burner (1) of any one of the preceding items, wherein D1<D3<D2<D4<D5, preferably wherein D1<D2<D3<D4<D5.

Item 33: The burner (1) of any one of the preceding items, wherein D2/D1 is between 1 and 2.5, particularly between 1.7 and 2.2.

Item 34: The burner (1) of any one of the preceding items, wherein D3/D1 is between 2 and 4, particularly between 2.5 and 3.3.

Item 35: The burner (1) of any one of the preceding items, wherein D4/D1 is between 3.5 and 6.5, particularly between 4.5 and 6.

Item 36: The burner (1) according to any one of the preceding items, wherein i) D2/D1 is between 1 and 2.5, particularly between 1.7 and 2.2; and/or ii) D3/D1 is between 2 and 4, particularly between 2.5 and 3.3; and/or iii) D4/D1 is between 3.5 and 6.5, particularly between 4.5 and 6.

Item 37: The burner (1) according to any one of the preceding items, wherein i) D2/D1 is between 1 and 2.5, particularly between 1.7 and 2.2; and ii) D3/D1 is between 2 and 4, particularly between 2.5 and 3.3; and iii) D4/D1 is between 3.5 and 6.5, particularly between 4.5 and 6.

Item 38: The burner (1) according to any one of the preceding items, wherein the outer wall (59) of the secondary fuel conduit (50) has an outer diameter D5.

Item 39: The burner (1) according to item 38, wherein D5/D1 is between 5 and

10.

Item 40: The burner (1) according to item 39, wherein D5/D1 is between 5.6 and 7.4.

Item 41: The burner (1) of any one of items 38 to 40, wherein i) D2/D1 is between 1 and 2.5, particularly between 1.7 and 2.2; and/or ii) D3/D1 is between 2 and 4, particularly between 2.5 and 3.3; and/or iii) D4/D1 is between 3.5 and 6.5, particularly between 4.5 and 6; and/or iv) D5/D1 is between 5 and 10, particularly between 5.6 and 7.4.

Item 42: The burner (1) of item 41, wherein i) D2/D1 is between 1 and 2.5, particularly between 1.7 and 2.2; and ii) D3/D1 is between 2 and 4, particularly between 2.5 and 3.3; and iii) D4/D1 is between 3.5 and 6.5, particularly between 4.5 and 6; and iv) D5/D1 is between 5 and 10, particularly between 5.6 and 7.4.

Item 43: The burner (1) of any one of the preceding items, wherein the swirl angle, which is defined to be the angle between the swirler blades and the plane parallel to the main axis of the burner (1) of the swirler, is from 5 to 60 degrees.

Item 44: The burner (1) of item 43, wherein the swirl angle is from 30 to 42 degrees.

Item 45: The burner (1) according to any one of the preceding items, wherein the main oxidant conduit (40) further comprises bleed holes (43), preferably wherein the bleed holes (43) are comprised within a bleed hole annulus (48).

Item 46: The burner (1) of any one of the preceding items, wherein the main oxidant conduit (40) comprises both a swirler section (42) and bleed holes (43), preferably wherein the bleed holes (43) are comprised within a bleed hole annulus (48).

Item 47: The burner (1) of item 45 or 46, wherein the bleed holes (43), and preferably said bleed hole annulus (48) comprising said bleed holes (43), are (is) arranged next to the swirler section (42) such that the main oxidant is able to pass through both the bleed holes (43) and the swirler section (42).

Item 48: The burner (1) of any of items 45 to 47, wherein said bleed holes (43), and preferably said bleed hole annulus (48) comprising said bleed holes (43), are (is) comprised in a downstream section of the main oxidant conduit (40) next to the auxiliary oxidant conduit (30).

Item 49: The burner (1) of any of items 45 to 48 wherein said bleed holes (43), and preferably said bleed hole annulus (48) comprising said bleed holes (43), are (is) arranged next to the swirler section (42) such that the main oxidant is able to pass through both the bleed holes (43) and the swirler section (42).

Item 50: The burner (1) of any one of the preceding items, wherein the burner (1) is configured in such a way that the velocity of the main oxidant at the main oxidant outlet is between 20 ft/s and 200 ft/s, particularly between 40 ft/s and 140 ft/s.

Item 51: The burner (1) of any one of the preceding items, wherein the burner (1) is configured in such a way that the velocity of the auxiliary oxidant at the auxiliary oxidant outlet is between 10 ft/s and 80 ft/s, particularly between 20 ft/s and 40 ft/s.

Item 52: The burner (1) of any one of the preceding items, wherein the burner (1) is configured in such a way that the velocity of the secondary fuel at the secondary fuel outlet is between 20 ft/s and 200 ft/s, particularly between 40 ft/s and 120 ft/s.

Item 53: The burner (1) of any one of the preceding items, wherein the burner (1) is configured in such a way that the velocity of the pilot fuel at the pilot fuel outlet (24) is between 30 ft/s and 250 ft/s, particularly between 60 ft/s and 120 ft/s.

Item 54: The burner (1) of any one of the preceding items, wherein i) the burner (1) is configured in such a way that the velocity of the main oxidant between 20 ft/s and 200 ft/s, particularly between 40 ft/s and 140 ft/s; and/or ii) the burner (1) is configured in such a way that the velocity of the auxiliary oxidant is between 10 ft/s and 80 ft/s, particularly between 20 ft/s and 40 ft/s; and/or iii) the burner (1) is configured in such a way that the velocity of the secondary fuel is between 20 ft/s and 200 ft/s, particularly between 40 ft/s and 120 ft/s; and/or iv) the burner (1) is configured in such a way that the velocity of the pilot fuel is between 30 ft/s and 250 ft/s, particularly between 60 ft/s and 120 ft/s. Preferably, all of the said velocities are the velocities at the respective outlets.

Item 55: The burner (1) of any one of the preceding items, wherein i) the burner (1) is configured in such a way that the velocity of the main oxidant between 20 ft/s and 200 ft/s, particularly between 40 ft/s and 140 ft/s; and ii) the burner (1) is configured in such a way that the velocity of the auxiliary oxidant is between 10 ft/s and 80 ft/s, particularly between 20 ft/s and 40 ft/s; and iii) the burner (1) is configured in such a way that the velocity of the secondary fuel is between 20 ft/s and 200 ft/s, particularly between 40 ft/s and 120 ft/s; and iv) the burner (1) is configured in such a way that the velocity of the pilot fuel is between 30 ft/s and 250 ft/s, particularly between 60 ft/s and 120 ft/s. Preferably, all of the said velocities are the velocities at the respective outlets.

Item 56: The burner (1) of any one of the preceding items, wherein the burner (1) is configured in such a way that the thermal output of the pilot fuel is about 5-15% of the thermal output of the main fuel at a start-up condition.

Item 57: The burner (1) of any one of the preceding items, wherein the burner (1) is configured in such a way that the start-up total thermal output of the burner (1) is provided by the main fuel to 100.

Item 58: The burner (1) of any one of the preceding items, wherein the burner (1) is configured in such a way that, during normal operation, the thermal output of the main fuel is 0-40% of the total thermal output of the burner (1).

Item 59: The burner (1) of any one of the preceding items, wherein the volumetric flow rate of the auxiliary oxidant is about 5-20% of the total oxidant flow rate of the burner (1).

Item 60: The burner (1) of any one of the preceding items, wherein i) the burner (1) is configured in such a way that the thermal output of the pilot fuel is about 5-15% of the thermal output of the main fuel at a start-up condition; and/or ii) the burner (1) is configured in such a way that the start-up total thermal output of the burner (1) is provided by the main fuel to 100; and/or iii) the burner (1) is configured in such a way that, during normal operation, the thermal output of the main fuel is 0-40% of the total thermal output of the burner (1);

and/or iv) the volumetric flow rate of the auxiliary oxidant is about 5-20% of the total oxidant flow rate of the burner (1).

Item 61: The burner (1) of item 60, wherein i) the burner (1) is configured in such a way that the thermal output of the pilot fuel is about 5-15% of the thermal output of the main fuel at a start-up condition; and/or ii) the burner (1) is configured in such a way that the start-up total thermal output of the burner (1) is provided by the main fuel to 100; and/or iii) the burner (1) is configured in such a way that, during normal operation, the thermal output of the main fuel is 0-40% of the total thermal output of the burner (1); and/or iv) the volumetric flow rate of the auxiliary oxidant is about 5-20% of the total oxidant flow rate of the burner (1).

Item 62: The burner (1) of any one of the preceding items, wherein the pilot fuel conduit (20) and the auxiliary oxidant conduit (30) are configured as a pilot burner for igniting the burner (1).

Item 63: The burner (1) of item 62, wherein the pilot burner is for igniting the main fuel.

Item 64: The burner (1) of item 62 or 63, wherein the auxiliary oxidant conduit (30) is configured to supply oxygen to the central main fuel lance (10) after the pilot burner has been shut off.

Item 65: The burner (1) of any one of preceding items, wherein the secondary fuel is a gaseous fuel.

Item 66: The burner (1) of any one of the preceding items, wherein the main fuel is a liquid fuel, the secondary fuel is a gaseous fuel, and the pilot fuel is a gaseous fuel.

Item 67: The burner (1) of any one of preceding items, wherein the secondary fuel is tailgas.

Item 68: The burner (1) of any one of preceding items, wherein the secondary fuel results from industrial processes.

Item 69: The burner (1) of any one of preceding items, wherein the secondary fuel is a process gas.

Item 70: The burner (1) of any one of preceding items, wherein the secondary fuel is selected from the group consisting of PSA waste gas, syngas, and a $H_2/CO/CO_2/CH_4$ mixture.

Item 71: The burner (1) of any one of preceding items, wherein the auxiliary oxidant conduit (30) comprises means for igniting (65) the pilot fuel.

Item 72: The burner (1) of any one of preceding items 1 to 70, wherein the pilot fuel conduit (20) comprises means for igniting (65) the pilot fuel.

Item 73: The burner (1) of any one of the preceding items, wherein the auxiliary oxidant conduit (30) and the pilot fuel conduit (20) comprise the means for igniting (65) the pilot fuel.

Item 74: The burner (1) of any one of the preceding items, wherein said means for igniting (65) the pilot fuel is an ignitor tube.

Item 75: The burner (1) of any of the preceding items, wherein the secondary fuel conduit (50) comprises means for generating turbulences (57).

Item 76: The burner (1) of any of the preceding items 1 to 74, wherein the secondary fuel conduit (50) comprises a turbulence generator (57).

Item 77: The burner (1) of item 75 or 76, wherein said means for generating turbulences or turbulence generator, respectively, comprise(s) one or more turbulence generator disk(s).

Item 78: The burner (1) of item 75 or 76, wherein said means for generating turbulences or turbulence generator, respectively, comprise(s) one or more turbulence generator plate(s).

Item 79: The burner (1) of item 75 or 76, wherein said means for generating turbulences or turbulence generator, respectively, are arranged at an additional wall (58) of the secondary fuel conduit (50), which is positioned next to the wall (49) of the main oxidant conduit (40).

Item 80: The burner (1) of any one of the preceding items, wherein the auxiliary oxidant conduit (30) further comprises air purge holes (37).

Item 81: The burner (1) of any one of the preceding items 1 to 79, wherein the main oxidant conduit (40) further comprises air purge holes (37).

Item 82: The burner (1) of item 80 or 81, wherein said air purge holes (37) are present upstream of the swirler section (42), preferably wherein said air purge holes (37) allow the passage of oxidant between the main oxidant conduit (40) and the auxiliary oxidant conduit (30).

Item 83: The burner (1) of any one of the preceding items, wherein the main oxidant comprises oxygen.

Item 84: The burner (1) of any one of the preceding items, wherein the auxiliary oxidant comprises oxygen.

Item 85: The burner (1) of any one of the preceding items, wherein the main oxidant comprises oxygen and the auxiliary oxidant comprises oxygen.

Item 86: The burner (1) of any one of items 56 or 58, wherein oxygen is comprised in the main and/or auxiliary oxidant in an amount of from 15 to 30% by volume.

Item 87: The burner (1) of any one of the preceding items, wherein the main oxidant is air.

Item 88: The burner (1) of any one of the preceding items, wherein the auxiliary oxidant is air.

Item 89: The burner (1) of any one of the preceding items, wherein the main oxidant is air and wherein the auxiliary oxidant is air.

Item 90: The burner (1) of any one of the preceding items, wherein the main oxidant conduit (40) and the auxiliary oxidant conduit (30) are both connected to the same oxidant supply, preferably wherein said conduits are both connected to the same oxidant supply using a control valve (60).

Item 91: The burner (1) of any one of the preceding items, wherein the oxidant is air.

Item 92: The burner (1) of any one of the preceding items, wherein each of the said conduits is configured as a pipe.

Item 93: The burner (1) of item 92, wherein each of the said conduits is configured as a pipe having a substantially round cross-section.

Item 94: The burner (1) of any of the preceding items, wherein all the said conduits are arranged essentially concentrically to each other.

Item 95: The burner (1) of any one of the preceding items, wherein each of the conduits has a substantially round cross-section.

Item 96: The burner (1) of any one of the preceding items, wherein central main fuel lance (10) is designated as a "lance 1".

Item 97: The burner (1) of any one of the preceding items, wherein central main fuel lance (10) is an air-assisted liquid fuel atomization lance.

Item 98: The burner (1) of any one of the preceding items 1 to 96, wherein central main fuel lance (10) is a pressure atomized liquid lance.

Item 99: The burner (1) of any one of the preceding items, wherein central main fuel lance (10) is arranged in the center of the burner (1), particularly wherein each of the other conduits is arranged concentrically around the central main fuel lance (10).

Item 100: The burner (1) of any one of the preceding items, wherein the pilot fuel conduit (20) is designated as a "pipe 1".

Item 101: The burner (1) of any one of the preceding items, wherein the pilot fuel conduit (20) comprises a plurality of exit holes (22) for the pilot fuel, particularly wherein the said exit holes (22) are arranged to surround the central main fuel lance (10).

Item 102: The burner (1) of item 101, wherein the exit holes (22) are positioned upstream of the main fuel outlet (14) of the central main fuel lance (10)—particularly by a distance L1.

Item 103: The burner (1) of any one of the preceding items, wherein the auxiliary oxidant conduit (30) is designated as a "pipe 2", particularly as an air pipe.

Item 104: The burner (1) of any one of the preceding items, wherein the auxiliary oxidant conduit (30) is designed to provide the oxidant for the pilot fuel, optionally wherein the auxiliary oxidant conduit (30) is designed to provide the oxidant for the pilot fuel as well as to provide the oxidant for the main fuel, particularly wherein said oxidants are provided successively.

Item 105: The burner (1) of any one of the preceding items, wherein the auxiliary oxidant is designated as "pilot air".

Item 106: The burner (1) of any one of the preceding items, wherein the main oxidant conduit (40) is designated as a "pipe 3", particularly as an air pipe.

Item 107: The burner (1) of any one of the preceding items, wherein the main oxidant conduit (40) comprises a swirler section (42), which is configured such that air introduced into the swirler section (42) induces a strong tangential flow field in the combustion chamber, particularly wherein i) the rate of mixing among the air, main fuel and secondary fuel is increased, and/or ii) a compact flame is created that fits within the short reaction chamber.

Item 108: The burner (1) of any one of the preceding items, wherein the secondary fuel conduit (50) is designated as a "pipe 4", particularly as a gaseous fuel pipe.

Item 109: The burner (1) of any one of the preceding items, wherein the secondary fuel conduit (50) is a tailgas conduit, particularly a tailgas pipe, especially wherein the conduit is configured for tailgas, which is further defined in accordance with any of the above items 68 to 70.

Item 110: The burner (1) of any one of the preceding items, wherein any of D1, D2, D3, D4 and D5 described above are defined as the diameters of the respective conduits, preferably wherein all of said conduits have essentially circular cross sections.

Item 111: The burner (1) of any one of the preceding items, wherein any of D1, D2, D3, D4 and D5 described above are defined as the diameters of the outlets of the respective conduits, preferably wherein all of said outlets have essentially circular cross sections.

Item 112: The burner (1) of any one items 13 to 111, wherein i) L1/D1 is between 1.0 and 10, particularly between 1.5 and 4; and/or ii) L2/D2 is between 0.05 and 10, particularly between 0.1 and 0.5; and/or iii) L3/D3 is between 0.05 and 10, particularly between 0.1 and 0.5.

Item 113: The burner (1) of any one items 13 to 112, wherein i) L1/D1 is between 1.0 and 10, particularly between 1.5 and 4; and ii) L2/D2 is between 0.05 and 10, particularly between 0.1 and 0.5; and iii) L3/D3 is between 0.05 and 10, particularly between 0.1 and 0.5.

Item 114: The burner (1) of any one of the preceding items, wherein all of the said conduits share a common central axis.

Item 115: The burner (1) of any one of the preceding items, wherein the central main fuel lance (10) is longer than the pilot fuel conduit (20), wherein the pilot fuel conduit (20) is longer than the auxiliary oxidant conduit (30), wherein the auxiliary oxidant conduit (30) is longer than the main oxidant conduit (40), and wherein the main oxidant conduit (40) is longer than the secondary fuel conduit (50).

Item 116: The burner (1) of any one of the preceding items, wherein the conduit end plane (56) of the secondary fuel conduit (50) is defined as the "hot face" of the burner (1).

Item 117: The burner (1) of any one of the preceding items, wherein all of the said conduits are concentrically disposed around a common longitudinal axis at least in the said downstream portion (5).

Item 118: The burner (1) of any one of the preceding items, wherein all of the said conduits are concentrically disposed around a common longitudinal axis.

Item 119: The burner (1) of any one of the preceding items, wherein all of the said conduits are essentially straight.

Item 120: The burner (1) of any one of the preceding items, wherein the central main fuel lance (10) further comprises a main fuel connector (11).

Item 121: The burner (1) of any one of the preceding items, wherein the main oxidant conduit (40) further comprises a main oxidant connector (41).

Item 122: The burner (1) of any one of the preceding items, wherein the secondary fuel conduit (50) further comprises a secondary fuel connector (51).

Item 123: The burner (1) of any one of the preceding items, wherein the pilot fuel conduit (20) further comprises a pilot fuel connector (21).

Item 124: The burner (1) of any one of the preceding items, wherein the auxiliary oxidant conduit (30) further comprises an auxiliary oxidant connector (31).

Item 125: The burner (1) of any one of the preceding items, wherein the burner (1) comprises a configuration as essentially depicted in any of the attached Figures or any combination thereof.

Item 126: A furnace comprising a burner (1) according to any one of items 1 to 125, particularly wherein the furnace is selected from the group consisting of a furnace for steam methane reforming, a reheat furnace in steel industries, and a secondary melting furnace.

Item 127: The furnace of item 126, wherein the furnace is further characterized by any features described in any of items 1 to 125.

Item 128: The furnace of item 126 or 127, wherein the furnace is further characterized by any further features of the burner defined elsewhere herein.

Item 129: A method for operating a burner (1) as defined in any one of the items 1 to 125, or for operating a furnace as defined in any one of items 126 and 127, the method comprising the steps of i) starting the burner (1) using the pilot fuel, and ii) providing and igniting the main fuel, the method optionally further comprising iii) closing the flow of the pilot fuel, particularly wherein said flow is closed after the main fuel has been ignited.

Item 130: The method of item 129, wherein the method additionally comprises further providing and igniting the secondary fuel.

Item 131: The method of any one of items 129 and 130, wherein the said secondary fuel is provided once it becomes available during an industrial process.

Item 132: The method of any one of items 129 to 131, wherein the method comprises a further step of continuing providing and combusting the pilot fuel where required, particularly at low turndown ratios, to keep the flame of the main fuel stable.

Item 133: The method of any one of items 129 to 131, wherein the method comprises a further step of continuing providing and combusting the pilot fuel where required, particularly for a hard to combust liquid main fuel, to keep the flame of the main fuel stable.

Item 134: The method of any one of items 129 to 133, wherein the method is further characterized by any features described in any of items 1 to 125.

Item 135: The method of any one of items 129 to 134, wherein the method is further characterized by any further features of the method defined elsewhere herein.

EXAMPLES

The following examples are used to further illustrate aspects of the invention, but are by no means intended to be limiting in any way.

Example 1

An example test burner (1) with air as oxidant and #2 fuel oil as liquid fuel and a mixture of ($H_2$, $CO_2$, $CH_4$) as a low BTU value tailgas fuel was designed, manufactured, and tested in a laboratory test furnace. The pilot fuel was natural gas and 10% air from the primary air was used as the pilot/auxillary air.

Figure 6:
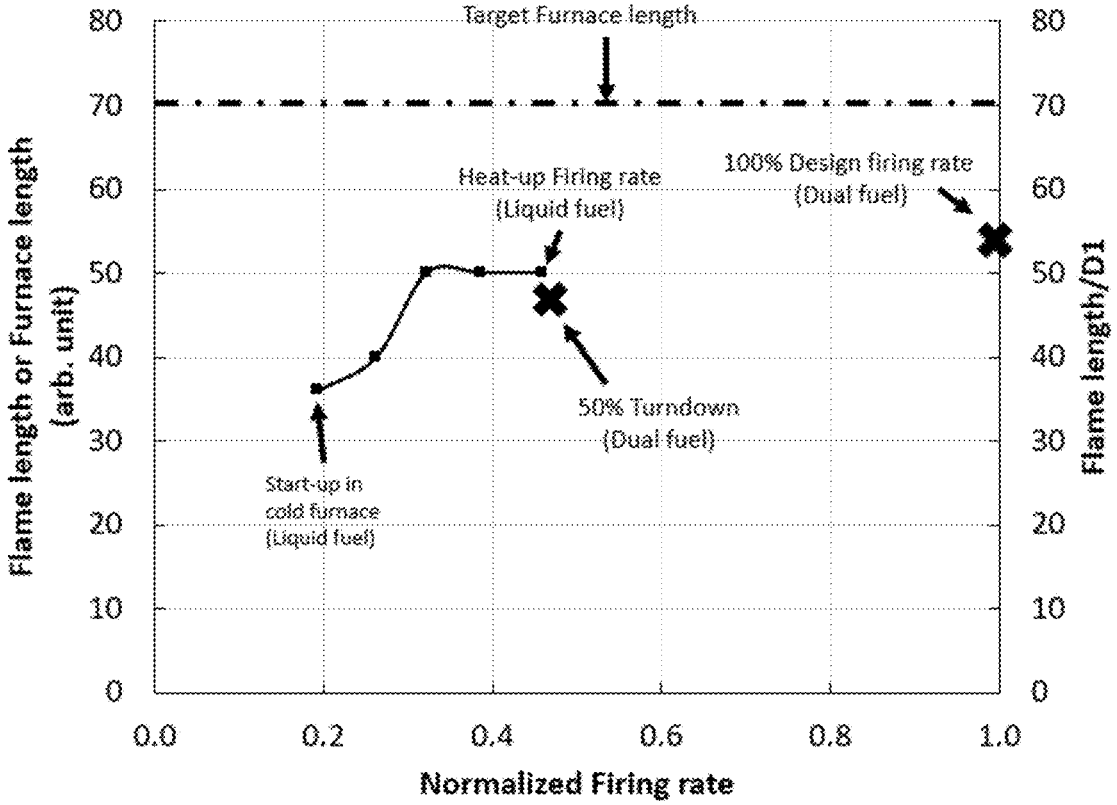
FIG. 6 depicts experimental results described herein.

The plot shown in FIG. 6 of flame length versus burner (1) firing rate shows that the flame length is about $2/3^{rd}$ the furnace length over a broad range of operating conditions (Start-up, full load at heat-up, 100% design firing rate, and 50% turndown condition, single-fuel operation, dual-fuel operation) in a relatively cold furnace. The average furnace wall temperature under these conditions was in the range 450 F-830 F. The ratio of mass flow rate of atomizing gas and mass flow ratio of liquid fuel is in the range of 0.025 to 0.5.

The plot in FIG. 6 of flame length vs burner firing rate shows that the flame length (L)/D1 is about 60.0 or less over a broad range of operating conditions. The fact that the present burner is able to produce a short flame under broad operating conditions is regarded to be due to multiple unique features of this burner. First, the combination of low exit velocity of the oil lance along with the presence of low velocity pilot air close to the oil lance helps to anchor the liquid fuel flame in a cold furnace. The use of lower exit velocities for the liquid fuel lance and pilot air or auxillary air allows to maintain the axial momentum flux low that can be overcome by the tangential/radial momentum flux setup by the swirl. Second, the turbulence generator in the tailgas pipe helps to increase the turbulence intensity of the secondary fuel stream that enables to increase the rate of mixing of the secondary fuel with the air and hence, complete the combustion process for secondary fuel in short downstream distance. These unique design aspect of the burner along with the particular velocity range of the fluid streams help to enhance oxidizer-fuel mixing thereby achieving complete combustion in short distances.

Example 2

Figure 5:
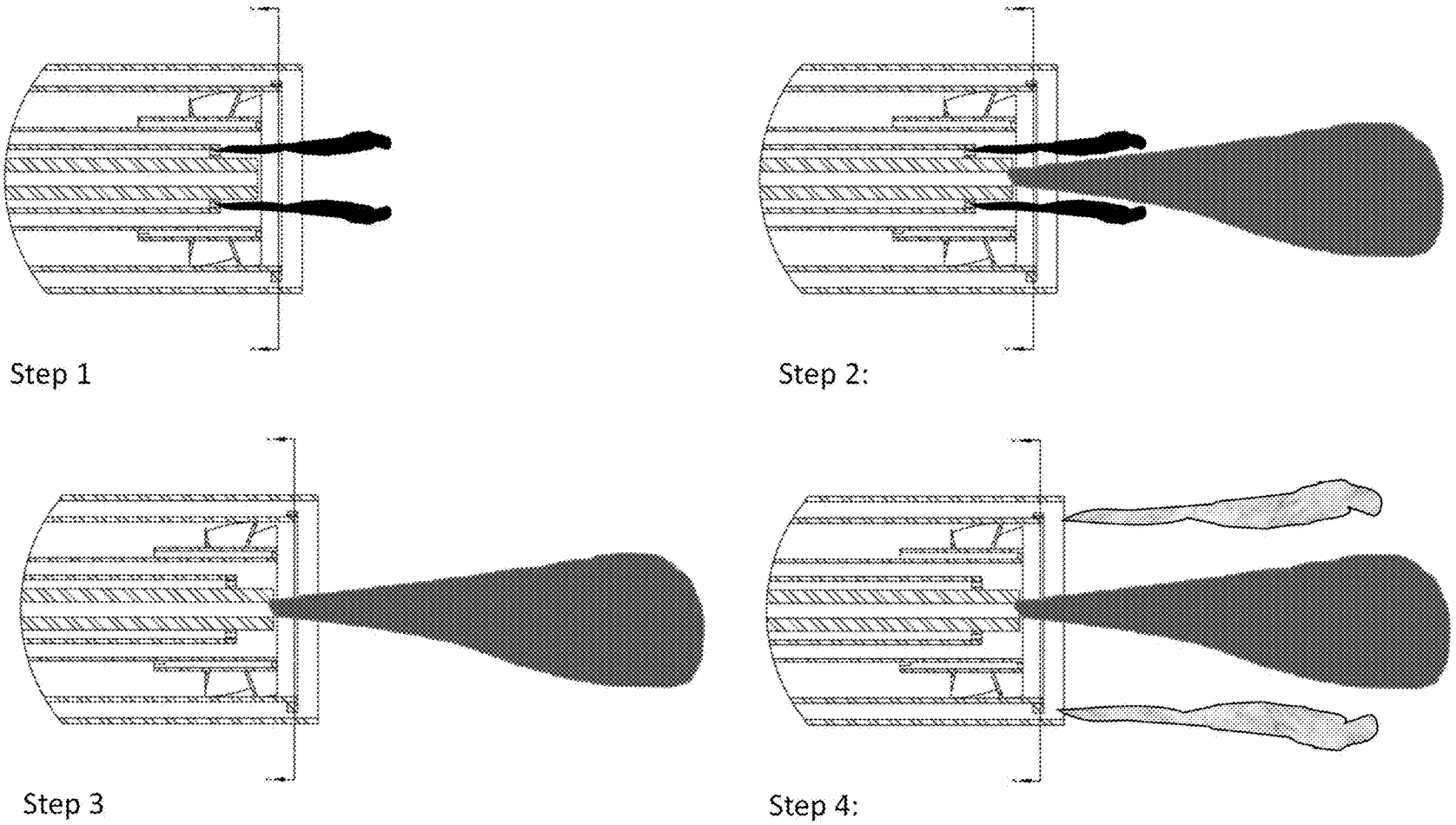
FIG. 5 is a schematic view involving cross sections similar to those of FIG. 3*a*, indicating an exemplary preferred way of operating the burner. In a particular embodiment, in step 1, the pilot flame is ON, in Step 2, the main fuel (here: liquid fuel ignites using the pilot flame, in Step 3, the pilot flame is OFF and a furnace may be heated up for processing, while in Step 4 the secondary fuel is additionally ON, which may e.g. be a low Btu/secondary gaseous fuel.

In the following example, a non-limiting exemplary detailed method of operating a burner (1) of the invention in accordance with the present invention is described (see also FIG. 5):

Step1: Start the primary air, this will also allow some air to flow through the pilot air pipe, start the igniter located in the pilot fuel or air pipe, and start the pilot fuel. This lights the pilot flame.

Step2: Once flame is lighted, the air-assisted liquid fuel flow is started. The heat release from the gaseous pilot fuel helps to ignite the liquid fuel. And, the main oxidant (e.g. primary air) of the burner (1) helps to anchor the liquid fuel flame within the recirculation zone of the swirler.

Step3: Once the liquid fuel burner (1) has ignited, the pilot fuel supply is turned OFF. The design of the oil lance and burner (1) design is as-such that the liquid fuel stays stable anchored while also producing a short flame that would fit inside a small reactor. The firing rate of the liquid fuel burner (1) is brought to the desired flow rate.

Step 4: Once the low BTU value fuel is available from the plant; it is introduced in the Tailgas pipe. The liquid fuel burner (1) now acts as a pilot burner for the low BTU flame.

In Step 1, the pilot flame is stable and ignites reliably in a cold furnace. The recess, L1 of the pilot fuel conduit helps to partially premix the pilot fuel and pilot air. Additionally, this recess allows a robust pilot flame anchoring location next to the pilot fuel injection exit holes (22), which is not impacted by the furnace atmosphere.

Furthermore, the pilot fuel flame sustains well at global equivalence ratios as low as 0.25, even at cold furnace conditions. The burner global equivalence ratio is low due to additional oxidant supplied by the primary oxidizer conduit until the liquid fuel supply is started to the burner. This stable performance of pilot flame is because of the unique configuration of burner hardware that includes the design of how the pilot fuel is injected through multiple holes (22), the location of pilot injection holes that is recessed by length L1, velocity ratio of the pilot fuel and auxiliary fuel, and ratio of volumetric flow rate of auxiliary oxidant as compared to the main oxidant. All these burner features allow a zone where local ignition can be initiated and sustained while the composite fuel-air mixture is still below the global burner lower flammability limit of natural gas, which occurs at an equivalence ratio of approximately 0.48. Specifically, this is due to the way the pilot fuel is injected through different jets that serves to mix the fuel with the auxiliary/pilot air creating numerous "pockets" of local fuel-air mixture having equivalence ratio within the flammable region, thereby enabling ignition to reliably and repeatably occur, in spite of the composite gas mixture having a non-flammable fuel concentration. Furthermore, a portion of primary air introduced into the auxiliary air conduit (30), entering via the peripheral wall holes (37) allows a combustion favourable local equivalence region to develop in the recessed region, L1.

The liquid fuel ignited in step 2 and developed stable flame in a cold furnace. This is possible because the pilot fuel is integral part of the main burner and it develops a symmetric flame in the vicinity of the main fuel lance. The heat release from the pilot flame helps to reliability and safely ignite the liquid fuel.

The operation of pilot flame can be stopped as needed as shown in Step 3. The liquid fuel flame continues to produce stable flame without the assistance from the pilot flame. Without bound by theory, presence of low velocity pilot air close to the oil lance helps to anchor the oil flame in a cold furnace. Additionally, the pilot fuel tube recessed by L1 length provides sufficient length for the pilot air to partially or fully develop before it comes out of the HOT face of the burner. This prevents any backflow of combustibles inside the fuel pipe1 when the pilot fuel is shut off.

For liquid fuels that are challenging to atomize and sustain stable flame below the auto-ignition temperature, the pilot flame can be used for continuous operation to help in combustion of these hard to combust liquid fuels (high viscocity, low Btu value fuels etc). This benefit isn't possible by traditional external pilot burner as it can cause asymmetry effects in the flame which can potentially lead to uneven heat flux, flame impingement on the sidewalls or worst-case flame blow-off when pilot fuel is turned off. In the current invention, the configuration of the burner allows the pilot flame to be symmetric and concentric around the liquid nozzle. This allows to provide a reliable source of ignition.

Additionally, the pilot fuel flame burner can also assist in very low turn down of the liquid fuel lance operation by providing a continuous source of ignition. This can enable a wider operating range for liquid fuel burner.

The inventive feature of assistance from pilot flame for hard to combust liquid fuels and robust flame anchoring zone for fuels that don't need pilot flame assistance allows the burner to produce a stable flame (without any lift-off) over a very broad range of equivalence ratio, even with an equivalence ratio as low as 0.25. These features enable pre-heating of the process furnace at a controlled rate to allow the process to initiate and come to a steady-state condition within a time-frame dictated by process requirements. This operational aspect of the burner allows the use of the same burner for process heat-up using liquid fuel and eliminates the need to have two different burners systems for heat-up and steady-state furnace operation.

The total thermal output is sum of the thermal output of fuels supplied through the tailgas gaseous and the liquid fuel. During the start-up condition of the plant, 100% of the thermal output is supplied using the liquid fuel. The heat from the liquid fuel is used to heat-up the plant to the desired temperature.

Under normal operation of the burner (1), about 0-40% of the total thermal output of the burner (1) is supplied using the liquid fuel and rest of the heat is supplied using the gaseous tailgas fuel.

The burner is able to produce a stable flame for a wide range of split of primary and secondary fuels. The primary fuel can supply 5% to 100% of the total burner thermal output and remaining balance coming from the secondary fuel. The main reason for this flexible performance is the strong flame anchoring zone for primary fuel provided by the low velocity of atomized fuel jet and pilot/auxillary air as discussed above that allows the primary fuel heat input to be reduced to as low as 5% of the total thermal output.

If need be, liquid fuel can be turned OFF, and the total thermal output can be supplied through tailgas. The fuel tube recess of L2+L3 length allows the the pilot air to develop before it comes out of the HOT face of the burner. Without intending to be bound by theory, this helps to keep the oil lance cool when the liquid fuel is shut off by preventing the hot gases from the combustion zone from impinging the exit of the oil lance.

The invention claimed is:

1. A burner (1), comprising a central main fuel lance (10) for supply of a liquid fuel having a main fuel outlet (14) at its downstream end, a main oxidant conduit (40) for supply of a main oxidant, having a main oxidant outlet (44) at its downstream end, a pilot fuel conduit (20) for supply of a gaseous pilot fuel, having a pilot fuel outlet (24) at its downstream end, and an auxiliary oxidant conduit (30) for supply of an auxiliary oxidant, having an auxiliary oxidant outlet (34) at its downstream end, wherein at least in the downstream portion (5) of the burner (1), in which main fuel outlet (14), main oxidant outlet (44), pilot fuel outlet (24) and auxiliary oxidant outlet (34) are present, the pilot fuel conduit (20), the auxiliary oxidant conduit (30) and the main oxidant conduit (40) are arranged concentrically around the central main fuel lance (10) so that central main fuel lance (10) is surrounded by the pilot fuel conduit (20), the auxiliary oxidant conduit (30) and the main oxidant conduit (40), wherein at least in said downstream portion (5) of the burner (1) the central main fuel lance (10), the pilot fuel conduit (20) and the auxiliary oxidant conduit (30) are surrounded by the main oxidant conduit (40);

wherein a conduit end plane (26/36) of the outermost in radial direction of pilot fuel conduit (20) and the auxiliary oxidant conduit (30) is recessed in an upstream direction from conduit end plane (46) of the main oxidant conduit (40) by a distance L2.

2. The burner (1) according to claim 1, which further comprises a secondary fuel conduit (50) for supply of a secondary fuel, having a secondary fuel outlet (54) at its downstream end, wherein at least in the downstream portion (5) of the burner (1), in which main fuel outlet (14), main oxidant outlet (44), pilot fuel outlet (24) and auxiliary oxidant outlet (34) are present, the secondary fuel conduit (50) is arranged concentrically around the central main fuel lance, and and wherein at least in said downstream portion (5) of the burner (1) the central main fuel lance (10), the pilot fuel conduit (20), the auxiliary oxidant conduit (30) and the main oxidant conduit (40) are surrounded fully or partially by the secondary fuel conduit (50).

3. The burner (1) according to claim 1, wherein i) means for igniting (65) the pilot fuel are present upstream the main fuel outlet (14) inside the pilot fuel conduit (20) and/or the auxiliary oxidant conduit (30); and/or ii) at least in said downstream portion (5) of the burner (1) the central main fuel lance (10), and the pilot fuel conduit (20) are surrounded by the auxiliary oxidant conduit (30).

4. The burner (1) according to claim 1, wherein the main oxidant conduit (40) in said downstream section of the burner (1) comprises a swirler section (42) upstream of the main oxidant outlet.

5. The burner (1) according to claim 1, wherein the outlet plane (25) of the pilot fuel outlet (24) is recessed in upstream direction from outlet plane (15) of the main fuel outlet (14) by a distance L1.

6. The burner (1) according to claim 5, wherein central main fuel lance wall (19) has an outer diameter D1 and wherein L1/D1 is between 0.5 and 15.

7. The burner (1) according to claim 1, wherein the innermost in radial direction of pilot fuel conduit wall (29) and auxiliary oxidant conduit wall (39) has an outer diameter D2 and wherein L2/D2 is between 0.05 and 10.

8. The burner (1) according to claim 1, wherein the main oxidant conduit (40) further comprises bleed holes (43), wherein i) the diameter of the bleed holes (43) is defined as P1, the outer diameter of the central main fuel lance wall is defined as D1 and wherein P1/D1 is between 0.02 and 0.2; and/or ii) said bleed holes (43) are comprised in a bleed hole annulus (48), wherein said bleed hole annulus (48) is arranged in fixed spatial relation between the outermost in radial direction of pilot fuel conduit wall (29) and auxiliary oxidant conduit wall (39), and a swirler section (42), wherein the bleed hole annulus exit comprises a purge air plate (47), which has a porosity (defined by the total open area on the plate that allows the air to flow divided by the cross-section area of the plate) in the range of 2% to 15%.

9. The burner (1) according to claim 1 wherein the central main fuel lance (10) is an air or another gas assisted atomization nozzle.

10. A burner (1), comprising a central main fuel lance (10) for supply of a liquid fuel having a main fuel outlet (14) at its downstream end, a main oxidant conduit (40) for supply of a main oxidant, having a main oxidant outlet (44) at its downstream end, a pilot fuel conduit (20) for supply of a gaseous pilot fuel, having a pilot fuel outlet (24) at its downstream end, and an auxiliary oxidant conduit (30) for supply of an auxiliary oxidant, having an auxiliary oxidant outlet (34) at its downstream end, wherein at least in the downstream portion (5) of the burner (1), in which main fuel outlet (14), main oxidant outlet (44), pilot fuel outlet (24) and auxiliary oxidant outlet (34) are present, the pilot fuel conduit (20), the auxiliary oxidant conduit (30) and the main oxidant conduit (40) are arranged concentrically around the central main fuel lance (10) so that central main fuel lance (10) is surrounded by the pilot fuel conduit (20), the auxiliary oxidant conduit (30) and the main oxidant conduit (40), wherein at least in said downstream portion (5) of the burner (1) the central main fuel lance (10), the pilot fuel conduit (20) and the auxiliary oxidant conduit (30) are surrounded by the main oxidant conduit (40);

wherein the outlet plane (25) of the pilot fuel outlet (24) is recessed in an upstream direction from outlet plane (15) of the main fuel outlet (14) by a distance L1;

wherein central main fuel lance wall (19) has an outer diameter D1 and wherein L1/D1 is between 0.5 and 15.

11. A burner (1), comprising a central main fuel lance (10) for supply of a liquid fuel having a main fuel outlet (14) at its downstream end, a main oxidant conduit (40) for supply of a main oxidant, having a main oxidant outlet (44) at its downstream end, a pilot fuel conduit (20) for supply of a gaseous pilot fuel, having a pilot fuel outlet (24) at its downstream end, and an auxiliary oxidant conduit (30) for supply of an auxiliary oxidant, having an auxiliary oxidant outlet (34) at its downstream end, a secondary fuel conduit (50) for supply of a secondary fuel, having a secondary fuel outlet (54) at its downstream end, wherein at least in the downstream portion (5) of the burner (1), in which main fuel outlet (14), main oxidant outlet (44), pilot fuel outlet (24) and auxiliary oxidant outlet (34) are present, the pilot fuel conduit (20), the auxiliary oxidant conduit (30) and the main oxidant conduit (40) are arranged concentrically around the central main fuel lance (10) so that central main fuel lance (10) is surrounded by the pilot fuel conduit (20), the auxiliary oxidant conduit (30) and the main oxidant conduit (40), wherein at least in said downstream portion (5) of the burner (1) the central main fuel lance (10), the pilot fuel conduit (20) and the auxiliary oxidant conduit (30) are surrounded by the main oxidant conduit (40);

wherein the conduit end plane (46) of the main oxidant conduit (40) is recessed in upstream direction from conduit end plane (56) of the secondary fuel conduit (50) by a distance L3;

wherein the outermost in radial direction of pilot fuel conduit wall (29) and auxiliary oxidant conduit wall (39) has an inner diameter D3 and wherein L3/D3 is between 0.05 and 10.

12. A burner (1), comprising a central main fuel lance (10) for supply of a liquid fuel having a main fuel outlet (14) at its downstream end, a main oxidant conduit (40) for supply of a main oxidant, having a main oxidant outlet (44) at its downstream end, a pilot fuel conduit (20) for supply of a gaseous pilot fuel, having a pilot fuel outlet (24) at its downstream end, and an auxiliary oxidant conduit (30) for supply of an auxiliary oxidant, having an auxiliary oxidant outlet (34) at its downstream end, wherein at least in the downstream portion (5) of the burner (1), in which main fuel outlet (14), main oxidant outlet (44), pilot fuel outlet (24) and auxiliary oxidant outlet (34) are present, the pilot fuel conduit (20), the auxiliary oxidant conduit (30) and the main oxidant conduit (40) are arranged concentrically around the central main fuel lance (10) so that central main fuel lance (10) is surrounded by the pilot fuel conduit (20), the auxiliary oxidant conduit (30) and the main oxidant conduit (40), wherein at least in said downstream portion (5) of the burner (1) the central main fuel lance (10), the pilot fuel conduit (20) and the auxiliary oxidant conduit (30) are surrounded by the main oxidant conduit (40);

wherein the conduit end plane (16) of the main fuel lance (10) is at the same downstream position as the conduit end plane (36) of the outermost in radial direction of pilot fuel conduit (20) and auxiliary oxidant conduit (30).

13. A burner (1), comprising a central main fuel lance (10) for supply of a liquid fuel having a main fuel outlet (14) at its downstream end, a main oxidant conduit (40) for supply of a main oxidant, having a main oxidant outlet (44) at its downstream end, a pilot fuel conduit (20) for supply of a gaseous pilot fuel, having a pilot fuel outlet (24) at its downstream end, and an auxiliary oxidant conduit (30) for supply of an auxiliary oxidant, having an auxiliary oxidant outlet (34) at its downstream end, wherein at least in the downstream portion (5) of the burner (1), in which main fuel outlet (14), main oxidant outlet (44), pilot fuel outlet (24) and auxiliary oxidant outlet (34) are present, the pilot fuel conduit (20), the auxiliary oxidant conduit (30) and the main oxidant conduit (40) are arranged concentrically around the central main fuel lance (10) so that central main fuel lance (10) is surrounded by the pilot fuel conduit (20), the auxiliary oxidant conduit (30) and the main oxidant conduit (40), wherein at least in said downstream portion (5) of the burner (1) the central main fuel lance (10), the pilot fuel conduit (20) and the auxiliary oxidant conduit (30) are surrounded by the main oxidant conduit (40); wherein the central main fuel lance wall (19) has an outer diameter D1, the innermost in radial direction of pilot fuel conduit wall (29) and auxiliary oxidant conduit wall (39) has an outer diameter D2, the outermost in radial direction of pilot fuel conduit wall (29) and auxiliary oxidant conduit wall (39) has an inner diameter D3, and the outer wall (49) of the main oxidant conduit (40) has an inner diameter D4, and wherein i) D2/D1 is between 1 and 2.5; and/or ii) D3/D1 is between 2 and 4; and/or iii) D4/D1 is between 3.5 and 6.5.

14. A burner (1), comprising a central main fuel lance (10) for supply of a liquid fuel having a main fuel outlet (14) at its downstream end, a main oxidant conduit (40) for supply of a main oxidant, having a main oxidant outlet (44) at its downstream end, a pilot fuel conduit (20) for supply of a gaseous pilot fuel, having a pilot fuel outlet (24) at its downstream end, and an auxiliary oxidant conduit (30) for supply of an auxiliary oxidant, having an auxiliary oxidant outlet (34) at its downstream end, a secondary fuel conduit (50) for supply of a secondary fuel, having a secondary fuel outlet (54) at its downstream end, wherein at least in the downstream portion (5) of the burner (1), in which main fuel outlet (14), main oxidant outlet (44), pilot fuel outlet (24) and auxiliary oxidant outlet (34) are present, the pilot fuel conduit (20), the auxiliary oxidant conduit (30) and the main oxidant conduit (40) are arranged concentrically around the central main fuel lance (10) so that central main fuel lance (10) is surrounded by the pilot fuel conduit (20), the auxiliary oxidant conduit (30) and the main oxidant conduit (40), wherein at least in said downstream portion (5) of the burner (1) the central main fuel lance (10), the pilot fuel conduit (20) and the auxiliary oxidant conduit (30) are surrounded by the main oxidant conduit (40);

wherein at least in the downstream portion (5) of the burner (1), in which main fuel outlet (14), main oxidant outlet (44), pilot fuel outlet (24) and auxiliary oxidant outlet (34) are present, the secondary fuel conduit (50) is arranged concentrically around the central main fuel lance, wherein at least in said downstream portion (5) of the burner (1) the central main fuel lance (10), the pilot fuel conduit (20), the auxiliary oxidant conduit (30) and the main oxidant conduit (40) are surrounded fully or partially by the secondary fuel conduit (50); and wherein the outer wall (59) of the secondary fuel conduit (50) has an outer diameter D5 and wherein D5/D1 is between 5 and 10.

15. A burner (1), comprising a central main fuel lance (10) for supply of a liquid fuel having a main fuel outlet (14) at its downstream end, a main oxidant conduit (40) for supply of a main oxidant, having a main oxidant outlet (44) at its downstream end, a pilot fuel conduit (20) for supply of a gaseous pilot fuel, having a pilot fuel outlet (24) at its downstream end, and an auxiliary oxidant conduit (30) for supply of an auxiliary oxidant, having an auxiliary oxidant outlet (34) at its downstream end, wherein at least in the downstream portion (5) of the burner (1), in which main fuel outlet (14), main oxidant outlet (44), pilot fuel outlet (24) and auxiliary oxidant outlet (34) are present, the pilot fuel conduit (20), the auxiliary oxidant conduit (30) and the main oxidant conduit (40) are arranged concentrically around the central main fuel lance (10) so that central main fuel lance (10) is surrounded by the pilot fuel conduit (20), the auxiliary oxidant conduit (30) and the main oxidant conduit (40), wherein at least in said downstream portion (5) of the burner (1) the central main fuel lance (10), the pilot fuel conduit (20) and the auxiliary oxidant conduit (30) are surrounded by the main oxidant conduit (40);

wherein the main oxidant conduit (40) in said downstream section of the burner (1) comprises a swirler section (42) upstream of the main oxidant outlet;

wherein the swirl angle, which is defined to be the angle between the swirler blades and the plane parallel to the main axis of the burner (1), is from 5 to 60 degrees.

16. A burner (1), comprising a central main fuel lance (10) for supply of a liquid fuel having a main fuel outlet (14) at its downstream end, a main oxidant conduit (40) for supply of a main oxidant, having a main oxidant outlet (44) at its downstream end, a pilot fuel conduit (20) for supply of a gaseous pilot fuel, having a pilot fuel outlet (24) at its downstream end, and an auxiliary oxidant conduit (30) for supply of an auxiliary oxidant, having an auxiliary oxidant outlet (34) at its downstream end, wherein at least in the downstream portion (5) of the burner (1), in which main fuel outlet (14), main oxidant outlet (44), pilot fuel outlet (24) and auxiliary oxidant outlet (34) are present, the pilot fuel conduit (20), the auxiliary oxidant conduit (30) and the main oxidant conduit (40) are arranged concentrically around the central main fuel lance (10) so that central main fuel lance (10) is surrounded by the pilot fuel conduit (20), the auxiliary oxidant conduit (30) and the main oxidant conduit (40), wherein at least in said downstream portion (5) of the burner (1) the central main fuel lance (10), the pilot fuel conduit (20) and the auxiliary oxidant conduit (30) are surrounded by the main oxidant conduit (40);

wherein the auxiliary oxidant conduit (30) further comprises air purge holes (37), wherein said air purge holes (37) are present upstream of a swirler section (42).

17. A burner (1), comprising a central main fuel lance (10) for supply of a liquid fuel having a main fuel outlet (14) at its downstream end, a main oxidant conduit (40) for supply of a main oxidant, having a main oxidant outlet (44) at its downstream end, a pilot fuel conduit (20) for supply of a gaseous pilot fuel, having a pilot fuel outlet (24) at its downstream end, and an auxiliary oxidant conduit (30) for supply of an auxiliary oxidant, having an auxiliary oxidant outlet (34) at its downstream end, wherein at least in the downstream portion (5) of the burner (1), in which main fuel outlet (14), main oxidant outlet (44), pilot fuel outlet (24) and auxiliary oxidant outlet (34) are present, the pilot fuel conduit (20), the auxiliary oxidant conduit (30) and the main oxidant conduit (40) are arranged concentrically around the central main fuel lance (10) so that central main fuel lance (10) is surrounded by the pilot fuel conduit (20), the auxiliary oxidant conduit (30) and the main oxidant conduit (40), wherein at least in said downstream portion (5) of the burner (1) the central main fuel lance (10), the pilot fuel conduit (20) and the auxiliary oxidant conduit (30) are surrounded by the main oxidant conduit (40);

wherein the pilot fuel conduit (20) exit further comprises a series of small exit holes (22), wherein i) the diameter of the exit holes (22) is defined as P0, the outer diameter of the central main fuel lance wall is defined as D1 and wherein P0/D1 is between 0.02 and 0.2; and/or ii) and/or said exit holes (22) are comprised in a pilot fuel exit plate (23), which has a porosity (defined by the total open area on the plate that allows the fuel to flow divided by the cross-section area of the plate) in the range of 2% to 25%; and/or iii) said exit holes (22) are arranged in fixed spatial location to create jets of pilot fuel.

18. A burner (1), comprising a central main fuel lance (10) for supply of a liquid fuel having a main fuel outlet (14) at its downstream end, a main oxidant conduit (40) for supply of a main oxidant, having a main oxidant outlet (44) at its downstream end, a pilot fuel conduit (20) for supply of a gaseous pilot fuel, having a pilot fuel outlet (24) at its downstream end, and an auxiliary oxidant conduit (30) for supply of an auxiliary oxidant, having an auxiliary oxidant outlet (34) at its downstream end, a secondary fuel conduit (50) for supply of a secondary fuel, having a secondary fuel outlet (54) at its downstream end, wherein at least in the downstream portion (5) of the burner (1), in which main fuel outlet (14), main oxidant outlet (44), pilot fuel outlet (24) and auxiliary oxidant outlet (34) are present, the pilot fuel conduit (20), the auxiliary oxidant conduit (30) and the main oxidant conduit (40) are arranged concentrically around the central main fuel lance (10) so that central main fuel lance (10) is surrounded by the pilot fuel conduit (20), the auxiliary oxidant conduit (30) and the main oxidant conduit (40), wherein at least in said downstream portion (5) of the burner (1) the central main fuel lance (10), the pilot fuel conduit (20) and the auxiliary oxidant conduit (30) are surrounded by the main oxidant conduit (40);

wherein the secondary fuel conduit (50) comprises a turbulence generator (57) upstream of its outlet plane (55).

19. A burner (1), comprising a central main fuel lance (10) for supply of a liquid fuel having a main fuel outlet (14) at its downstream end, a main oxidant conduit (40) for supply of a main oxidant, having a main oxidant outlet (44) at its downstream end, a pilot fuel conduit (20) for supply of a gaseous pilot fuel, having a pilot fuel outlet (24) at its downstream end, and an auxiliary oxidant conduit (30) for supply of an auxiliary oxidant, having an auxiliary oxidant outlet (34) at its downstream end, a secondary fuel conduit (50) for supply of a secondary fuel, having a secondary fuel outlet (54) at its downstream end, wherein at least in the downstream portion (5) of the burner (1), in which main fuel outlet (14), main oxidant outlet (44), pilot fuel outlet (24) and auxiliary oxidant outlet (34) are present, the pilot fuel conduit (20), the auxiliary oxidant conduit (30) and the main oxidant conduit (40) are arranged concentrically around the central main fuel lance (10) so that central main fuel lance (10) is surrounded by the pilot fuel conduit (20), the auxiliary oxidant conduit (30) and the main oxidant conduit (40), wherein at least in said downstream portion (5) of the burner (1) the central main fuel lance (10), the pilot fuel conduit (20) and the auxiliary oxidant conduit (30) are surrounded by the main oxidant conduit (40);

wherein i) the burner (1) is configured in such a way that the velocity of the main oxidant at the main oxidant outlet is between 20 ft/s and 200 ft/s; and/or ii) the burner (1) is configured in such a way that the velocity of the auxiliary oxidant at the auxiliary oxidant outlet is between 10 ft/s and 80 ft/s; and/or iii) the burner (1) is configured in such a way that the velocity of the secondary fuel at the secondary fuel outlet is between 20 ft/s and 200 ft/s; and/or iv) the burner (1) is configured in such a way that the velocity of the pilot fuel at the pilot fuel outlet (24) is between 30 ft/s and 250 ft/s.

* * * * *